US010144602B2

(12) United States Patent
Kuwabara et al.

(10) Patent No.: US 10,144,602 B2
(45) Date of Patent: Dec. 4, 2018

(54) RECORDING-MEDIUM FEEDING DEVICE AND PROCESSING APPARATUS EQUIPPED WITH THE SAME

(71) Applicant: FUJI XEROX CO., LTD., Tokyo (JP)

(72) Inventors: Daisuke Kuwabara, Kanagawa (JP); Hiroyuki Suzuki, Kanagawa (JP); Tomohiro Takano, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 162 days.

(21) Appl. No.: 15/060,675

(22) Filed: Mar. 4, 2016

(65) Prior Publication Data

US 2017/0090381 A1 Mar. 30, 2017

(30) Foreign Application Priority Data

Sep. 28, 2015 (JP) ..... 2015-190256

(51) Int. Cl.
*B65H 3/52* (2006.01)
*B65H 1/04* (2006.01)
(Continued)

(52) U.S. Cl.
CPC ..... *B65H 3/5215* (2013.01); *B65H 1/04* (2013.01); *B65H 3/0669* (2013.01); *B65H 3/34* (2013.01);
(Continued)

(58) Field of Classification Search
CPC ... B65H 1/04; B65H 1/08; B65H 3/02; B65H 3/06; B65H 3/50; B65H 3/52;
(Continued)

(56) References Cited

U.S. PATENT DOCUMENTS 7,387,297 B2 * 6/2008 Moore ..... B65H 3/0676 271/10.09
7,735,825 B2 * 6/2010 Seike ..... B65H 3/06 271/227
(Continued)

FOREIGN PATENT DOCUMENTS

JP 5-10354 U 2/1993

*Primary Examiner* — Ernesto A Suarez
(74) *Attorney, Agent, or Firm* — Sughrue Mion, PLLC

(57) ABSTRACT

A recording-medium feeding device includes a container, a separating mechanism, and a suppressing member. The container accommodates recording media. The separating mechanism includes a driving member, a separating member, and a torque limiter. The driving member comes into contact with and delivers an uppermost recording medium. The separating member separates the recording media one-by-one. When a rotational torque smaller than a predetermined rotational torque is applied to the torque limiter, the torque limiter repels a load of the rotational torque to inhibit rotation of the separating member. When a rotational torque larger than or equal to the predetermined rotational torque is applied to the torque limiter, the torque limiter allows the separating member to be rotationally driven in accordance with the load. The suppressing member suppresses receding movement of the recording media caused by reverse rotation of the separating member when the driving member stops.

9 Claims, 19 Drawing Sheets

(51) Int. Cl.
*B65H 3/06* (2006.01)
*B65H 3/34* (2006.01)
*G03G 15/00* (2006.01)

(52) U.S. Cl.
CPC ..... *G03G 15/6511* (2013.01); *G03G 15/6529* (2013.01); *B65H 2403/72* (2013.01)

(58) Field of Classification Search
CPC .. B65H 3/5246; B65H 3/5253; B65H 3/5361; B65H 3/5269; B65H 3/5276; B65H 3/5284; B65H 3/5292; B65H 3/54; B65H 3/56; B65H 3/565
See application file for complete search history.

(56) References Cited

U.S. PATENT DOCUMENTS

| | | | | |
|---|---|---|---|---|
| 7,922,169 | B2 * | 4/2011 | Mandel | B65H 3/0684 271/121 |
| 7,980,549 | B2 * | 7/2011 | Hamaguchi | B65H 3/0684 271/10.04 |
| 2008/0012201 | A1 * | 1/2008 | Nakashima | B65H 3/0684 271/12 |
| 2011/0024970 | A1 * | 2/2011 | Uchida | B65H 1/14 271/10.16 |

* cited by examiner

RECORDING-MEDIUM FEEDING DEVICE AND PROCESSING APPARATUS EQUIPPED WITH THE SAME

CROSS-REFERENCE TO RELATED APPLICATIONS

This application is based on and claims priority under 35 U.S.C. 119 from Japanese Patent Application No. 2015-190256 filed Sep. 28, 2015.

BACKGROUND

Technical Field

The present invention relates to recording-medium feeding devices and processing apparatuses equipped with the same.

SUMMARY

According to an aspect of the invention, there is provided a recording-medium feeding device including a container, a separating mechanism, and a suppressing member. The container accommodates a recording-medium bundle including multiple stacked recording media. The separating mechanism includes a driving member, a separating member, and a torque limiter. The driving member is provided toward a recording-medium delivery direction in the container. The driving member comes into contact with an uppermost recording medium of the recording-medium bundle accommodated in the container and is rotationally driven to deliver the recording medium. The separating member is rotationally drivable by coming into contact with the driving member and separates the recording media from each other in a one-by-one fashion. The torque limiter is incorporated in the separating member. When a rotational torque smaller than a predetermined rotational torque is applied to the torque limiter, the torque limiter repels a load of the rotational torque so as to inhibit rotation of the separating member. When a rotational torque larger than or equal to the predetermined rotational torque is applied to the torque limiter, the torque limiter allows the separating member to be rotationally driven in accordance with the load of the rotational torque. The suppressing member suppresses receding movement of the recording media caused by reverse rotation of the separating member when the driving member of the separating mechanism stops.

BRIEF DESCRIPTION OF THE DRAWINGS

Exemplary embodiments of the present invention will be described in detail based on the following figures, wherein.

DETAILED DESCRIPTION

Overview of Exemplary Embodiment

Figure 1A:
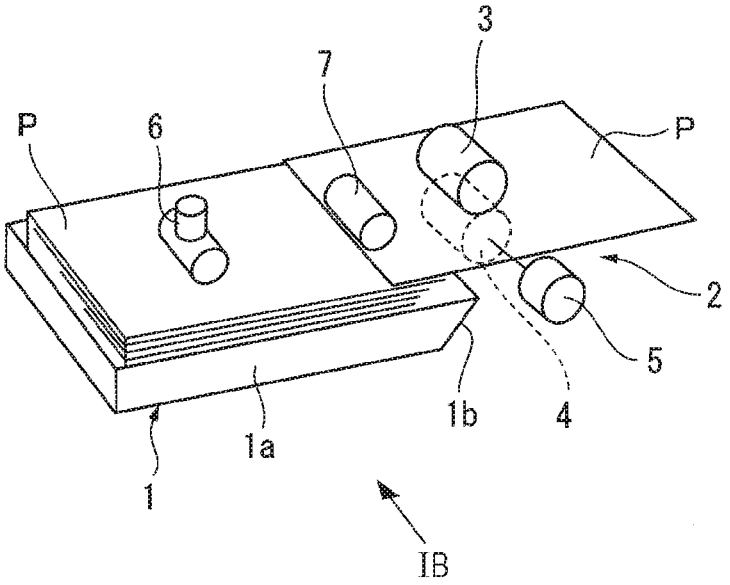
FIG. 1A schematically illustrates a recording-medium feeding device according to an exemplary embodiment of the present invention.
Figure 1B:
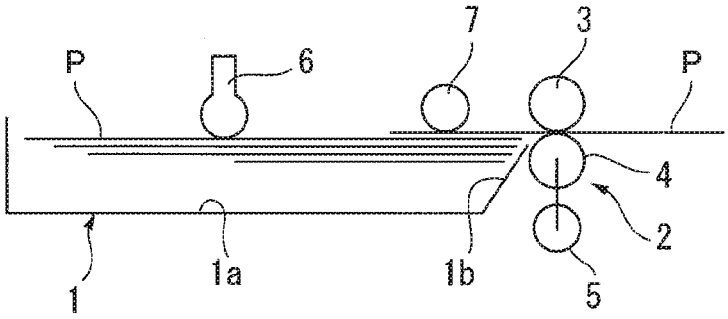
FIG. 1B illustrates the recording-medium feeding device, as viewed from a direction indicated by an arrow IB in FIG. 1A.

FIG. 1A schematically illustrates a recording-medium feeding device according to an exemplary embodiment of the present invention, and FIG. 1B illustrates the recording-medium feeding device, as viewed from a direction indicated by an arrow IB in FIG. 1A.

In FIGS. 1A and 1B, the recording-medium feeding device according to this exemplary embodiment includes a container 1; a separating mechanism 2 including a driving member 3, a separating member 4, and a torque limiter 5; and a suppressing member 6. The container 1 accommodates a bundle of multiple stacked recording media P. The driving member 3 is provided toward the delivery direction of the recording media P in the container 1. The driving member 3 comes into contact with the uppermost recording medium P of the recording-medium bundle accommodated in the container 1 and is rotationally driven to deliver the recording medium P. The separating member 4 is rotationally drivable by coming into contact with the driving member 3 and separates the recording media P from each other in a one-by-one fashion. The torque limiter 5 is incorporated in the separating member 4. When a rotational torque smaller than a predetermined rotational torque is applied to the torque limiter 5, the torque limiter 5 repels the load of the rotational torque so as to inhibit rotation of the separating member 4. When a rotational torque larger than or equal to the predetermined rotational torque is applied to the torque limiter 5, the torque limiter 5 allows the separating member 4 to be rotationally driven in accordance with the load of the rotational torque. When the driving member 3 of the separating mechanism 2 stops, the suppressing member 6 suppresses receding movement of the recording media P caused by reverse rotation of the separating member 4.

In this technical configuration, the type of recording media P is not particularly limited and may include high-quality paper, coated paper, or films so long as a process, such as an image forming process, is performable thereon. The container 1 may have any of various appropriate shapes, such as a tray shape or a box shape, so long as it is capable of accommodating a stack of recording media P. With regard to the torque limiter 5, a spring type that uses, for example, a coil spring is assumed to have a large effect on the receding movement of the recording media P, which is the technical problem of the present application. However, a torque limiter 5 of other types that affect the receding movement of the recording media P is also included in the present application. Although a representative type of the suppressing member 6 is a weight, other alternative types, such as a type that presses against the top surface of the recording media P or a type that presses against an edge or edges of the recording media P, may be appropriately selected so long as the suppressing member 6 is capable of suppressing the receding movement of the recording media P (i.e., movement thereof in a direction opposite to the delivery direction). The suppressing member 6 may also be regarded as a functional member that restrains the uppermost portion of the recording media P.

The operation of the separating mechanism 2 equipped with, for example, a spring-type torque limiter 5 will now be described. Reference sign 1*a* denotes an accommodation section of the container 1 where the recording media P are accommodated in a substantially horizontal position. Reference sign 1*b* denotes an inclined section of the container 1, which is inclined upward at an angle in the delivery direction of the recording media P. Reference sign 7 denotes a feed member that feeds each recording medium P toward the separating mechanism 2.

First, an operation performed by the separating mechanism 2 for separating the recording media P from each other will be described with reference to FIGS. 2A and 2B.

Figure 2A:
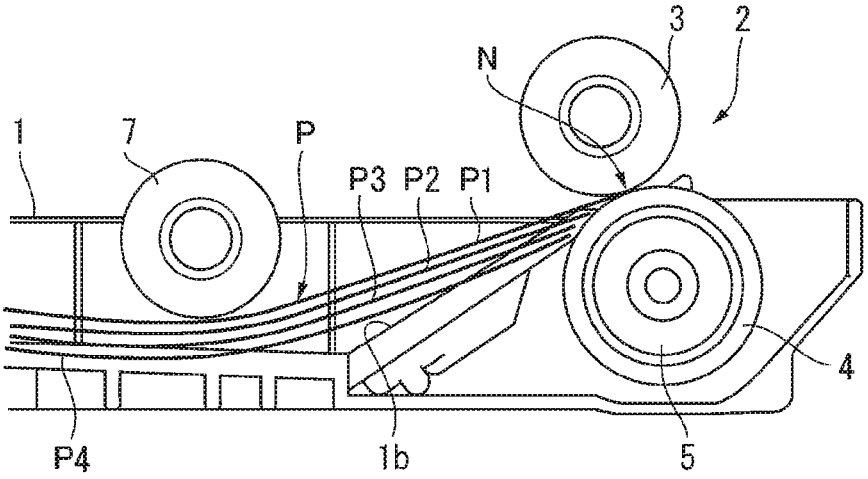
FIG. 2A illustrates a state where a single sheet of recording medium is being delivered from a nip region of a separating mechanism.
Figure 2B:
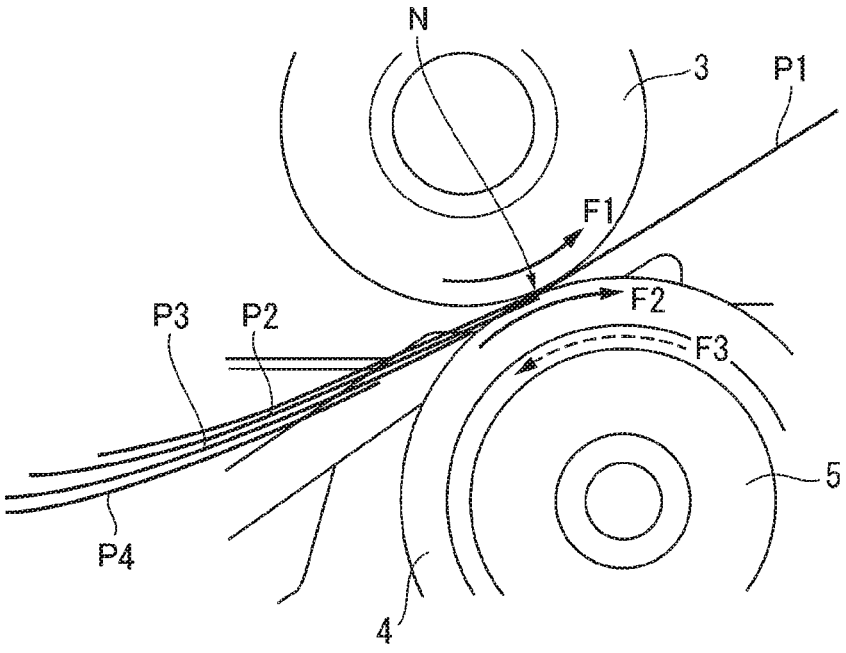
FIG. 2B illustrates the principle of a recording-medium separating operation performed by the separating mechanism.

Referring to FIG. 2A, when driving of the driving member 3 of the separating mechanism 2 commences in a state where a recording medium P has not reached a nip region N (which corresponds to a contact region between the driving member 3 and the separating member 4), a rotational driving force F1 of the driving member 3 is transmitted to the separating member 4 via the nip region N, whereby a rotational torque F2 acts on the separating member 4. In this case, although the separating member 4 normally receives a predetermined rotational load F3 from the torque limiter 5 in the counter-rotational direction against the rotational direction of the separating member 4, the separating member 4 rotates by being driven by the driving member 3 because the rotational torque F2 transmitted from the driving member 3 is larger than the normal rotational load F3. However, during this time, the rotational load F3 from the torque limiter 5 acts in the counter-rotational direction.

When the feed member 7 commences a pickup operation (i.e., a feeding operation) on the bundle of recording media P in this state, the uppermost recording medium P (P1) of the bundle of recording media P is fed toward the nip region N of the separating mechanism 2 via the inclined section 1*b* of the container 1 in principle. In this case, the feed member 7 feeds the uppermost recording medium P (P1) in a state where the feed member 7 is pressed against the bundle of stacked recording media P. However, depending on conditions, multiple sheets of recording media P (i.e., four sheets including the uppermost recording medium P in FIGS. 2A and 2B) may sometimes be fed together with the uppermost recording medium P (P1) due to frictional force acting between the recording media P.

Assuming that only the single uppermost recording medium P (P1) reaches the nip region N of the separating mechanism 2, since the rotational driving force F1 of the driving member 3 is transmitted to the separating member 4 with the single recording medium P (P1) nipped therebetween, the rotational torque F2 acting on the separating member 4 is large enough to prevail against the rotational load F3 from the torque limiter 5. Therefore, the separating member 4 rotates together with the driving member 3, so that the single recording medium P (P1) that has reached the nip region N of the separating mechanism 2 receives the rotational force from the driving member 3 and the separating member 4 and is thus delivered downstream.

In contrast, assuming that multiple sheets (e.g., two sheets) of recording media P (P1 and P2) reach the nip region N of the separating mechanism 2, the rotational driving force F1 of the driving member 3 is transmitted to the uppermost first sheet of recording medium P (P1), so that the uppermost first sheet of recording medium P (P1) is delivered by the rotational driving force F1 of the driving member 3. However, because a slipping effect occurs between the uppermost first sheet of recording medium P (P1) and the second sheet of recording medium P (P2), the rotational driving force F1 of the driving member 3 is not transmitted to the separating member 4, so that the rotational torque F2 acting on the separating member 4 is not large enough. Thus, the rotational torque F2 acting on the separating member 4 is not large enough to prevail against the rotational load F3 from the torque limiter 5. This implies that the separating member 4 does not rotate, and the second sheet of recording medium P (P2) in contact with the separating member 4 is therefore not delivered. Consequently, in this case, the separating operation of the recording media P is performed such that only the uppermost first sheet of recording medium P (P1) in contact with the driving member 3 is delivered while the second sheet of recording medium P (P2) in contact with the separating member 4 is left behind.

Figure 3A:
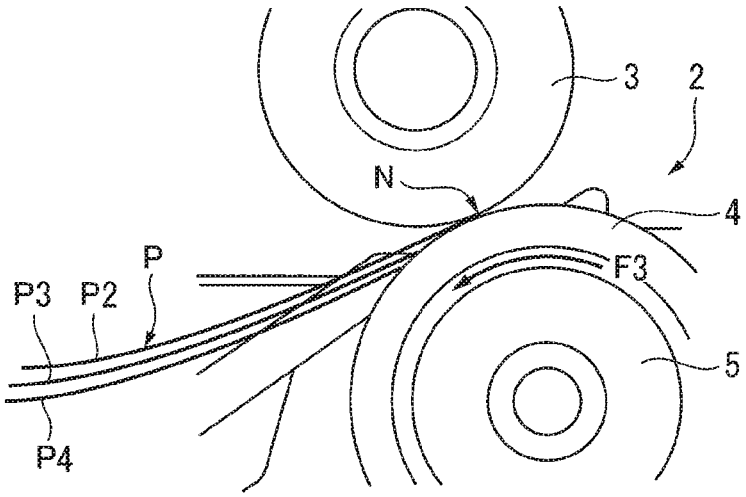
FIG. 3A illustrates a state where a driving roller of a separating mechanism has stopped in a recording-medium feeding device according to a comparative example (not equipped with a suppressing member)
Figure 3B:
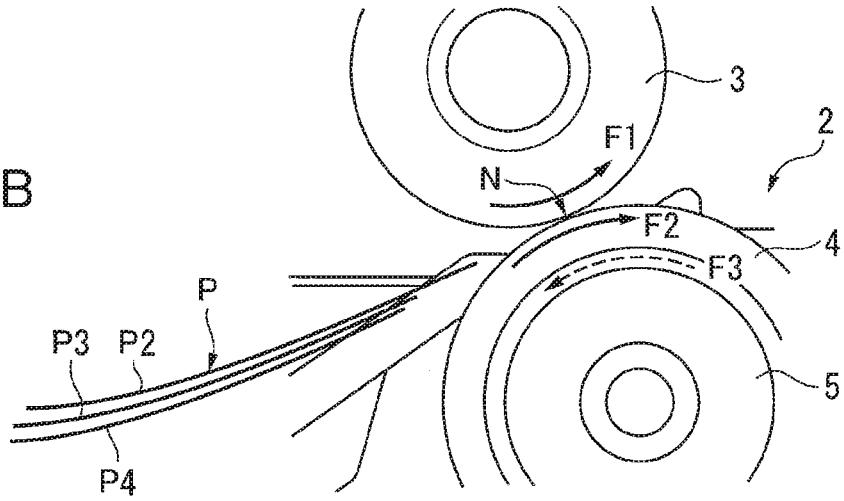
FIG. 3B illustrates a first example of receding behavior of recording media occurring in the situation in FIG. 3A.
Figure 3C:
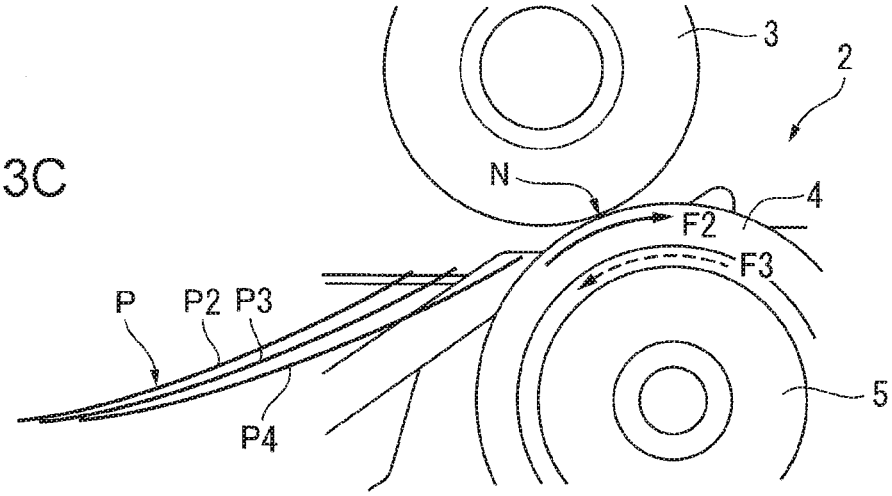
FIG. 3C illustrates a second example of receding behavior of recording media occurring in the same situation.

Next, the behavior of recording media P in a case where the driving member 3 of the separating mechanism 2 has stopped in a recording-medium feeding device according to a comparative example (equipped with the separating mechanism 2 and the feed member 7 but not equipped with the suppressing member 6) will be described with reference to FIGS. 3A to 3C. In FIGS. 3A to 3C, four sheets of recording media P (P1 to P4) are shown as an example.

FIG. 3A illustrates the behavior of the second to fourth sheets of recording media P (P2 to P4) when the driving of the driving member 3 of the separating mechanism 2 is stopped immediately after the first sheet of recording medium P (P1) is delivered from the nip region N of the separating mechanism 2.

Referring to FIG. 3A, when the driving of the driving member 3 of the separating mechanism 2 is stopped, the rotational torque F2 no longer acts on the separating member 4 so that the rotational load F3 of the spring-type torque limiter 5 is released. Then, in the spring-type torque limiter 5, a so-called spring-back effect causes the separating member 4 to rotate in the reverse direction of the delivery direction of the recording media P so as to return slightly in the reverse direction.

When the spring-back effect of the torque limiter 5 causes the separating member 4 to return in the reverse direction, the returning movement of the separating member 4 causes the second sheet of recording medium P (P2) in contact with the separating member 4 to recede from the nip region N of the separating mechanism 2. Thus, the second sheet of recording medium P (P2) moves away from the nip region N in the counter-delivery direction that is different from the delivery direction of the recording media P.

When the second sheet of recording medium P (P2) recedes from the nip region N, the leading edge of the second sheet of recording medium P (P2) (which corresponds to the uppermost surface in this case) is returned closer to the nip region N than the leading edges of the subsequent sheets of recording media P (P3 and P4), as shown in, for example, FIG. 3B, or the leading edge of the second sheet of recording medium P (P2) is returned farther away from the nip region N than the leading edge of any one of the subsequent sheets of recording media P (P3 and P4), as shown in FIG. 3C.

In the state shown in FIG. 3B, the second sheet of recording medium P (P2) (which corresponds to the uppermost surface in this case) is closer to the nip region N than the third and fourth sheets of recording media P (P3 and P4). Therefore, when the feed member 7 performs the feeding operation, even if the subsequent third sheet of recording medium P (P3) reaches the nip region N after the uppermost second sheet of recording medium P (P2) first reaches the nip region N, the second sheet of recording medium P (P2) is separated and delivered due to the separating effect of the separating mechanism 2.

However, the state shown in FIG. 3C may possibly lead to multi-feeding of recording media P when subsequently feeding the recording medium P (P2). Specifically, when the feeding operation of the feed member 7 causes the second sheet of recording medium P (P2) to be fed and accordingly causes the third and fourth sheets of recording media P to follow the second sheet of recording medium P (P2), the third sheet of recording medium P (P3) reaches the nip region N first, and then the uppermost recording medium P reaches the nip region N. In this state, when the third sheet of recording medium P (P3) is delivered by the driving member 3 and the separating member 4 and the second sheet of recording medium P (P2) subsequently reaches the nip region N, the separating mechanism 2 delivers the second sheet of recording medium P (P2) together with the third sheet of recording medium P (P3) from the nip region N, possibly leading to multi-feeding of recording media P. Furthermore, such a multi-feeding phenomenon of recording media P tends to occur due to, for example, mechanical vibration caused by an ascending-descending operation of the feed member 7 in addition to the effect of the torque limiter 5.

In this exemplary embodiment, the suppressing member 6 suppresses receding movement of the recording media P so as to prevent such multi-feeding of recording media P in the separating mechanism 2.

For example, when the first sheet of recording medium P is delivered from the nip region N of the separating mechanism 2, as shown in FIG. 3A, the suppressing member 6 suppresses receding movement of the second sheet of recording medium P (P2) so as to prevent this recording medium P (P2) from moving in the counter-delivery direction. Therefore, supposing that the separating member 4 returns in the reverse direction due to the torque limiter 5, movement of the recording media P in the container 1 in the counter-delivery direction is suppressed, so that there is substantially no possibility of the leading edge of the second sheet of recording medium P (P2, which is the uppermost surface in this case) being positioned farther away from the nip region N than the leading edge of a subsequent recording medium P. In other words, as described above, the recording-medium returning state shown in FIG. 3C that may cause multi-feeding of recording media P may be avoided. Consequently, multi-feeding of recording media P may be minimized when delivering a recording medium P from the nip region N of the separating mechanism 2.

Next, a representative configuration used in this exemplary embodiment will be described.

In this representative configuration, the suppressing member 6 is provided in an accessary component attachable to and detachable from the container 1. Such a suppressing member 6 may be attached to or detached from the container 1 when accommodating the recording media P into the container 1. Alternatively, the suppressing member 6 may be attached to or detached from the container 1, for example, when starting the operation of the recording-medium feeding device or when there is a change in environment.

A representative installation position of the suppressing member 6 includes a position located on the uppermost surface of the recording-medium bundle accommodated in the container 1 and opposite from the separating mechanism 2 in the delivery direction of the recording media P. The installation position of the suppressing member 6 may be appropriately selected so long as the suppressing member 6 is capable of suppressing the receding movement of the recording media P at that position. However, since the installation space, such as lateral regions of the separating mechanism 2, is limited, the suppressing member 6 may be installed at a position irrelevant to the separating mechanism 2, as in this example.

Furthermore, as the suppressing member 6, a weight whose weight is changeable may be disposed on the uppermost surface of the recording-medium bundle accommodated in the container 1. Examples of such a weight-changeable weight include an example equipped with multiple types of weights, an example having multiple types of suppressing members 6 with different weights, and an example in which the number of suppressing members 6 is changeable. With regard to the example equipped with multiple types of weights, the suppressing member 6 itself has a shape that may carry the weights. With regard to the example having multiple types of replaceable suppressing members 6, a structure that allows for replacement of the suppressing members 6 is provided.

Furthermore, as an example of the container 1, the container 1 may have the accommodation section 1*a* that accommodates the recording media P in a substantially horizontal position and the inclined section 1*b* that is inclined upward at an angle from the accommodation section 1*a* to the separating position of the separating mechanism 2. In the container 1 having the inclined section 1*b* as in this example, each recording medium P within the container 1 may be delivered toward the separating mechanism 2 more readily than in a case where the inclined section 1*b* is not provided. In this example, the inclined section 1*b* is provided in addition to the accommodation section 1*a*. The inclined section 1*b* allows each recording medium P to recede readily.

The bottom of the container 1 may have a guide section extending in the delivery direction of the recording media P, and the suppressing member 6 may have a pressing section at a position corresponding to the guide section. The pressing section and the guide section may sandwich and press against the recording-medium bundle accommodated in the container 1. For example, if the container 1 is composed of plastic, the guide section is obtained by forming, for example, ribs during the molding process, and the suppressing member 6 may be disposed in accordance with the position of these ribs. By providing such a guide section, the area in which the lowermost surface of the recording-medium bundle within the container 1 comes into contact with the container 1 is minimized, so that the load applied when delivering each recording medium P is reduced. Furthermore, with the suppressing member 6 facing the guide section, the receding suppression effect on each recording medium P may be stably exhibited by the suppressing member 6.

In order to stably feed each recording medium P, the feed member 7 may be provided in the container 1 in an ascendable-descendible manner at a position opposite from the separating mechanism 2 in the delivery direction of the recording media P. When descending, the feed member 7 comes into contact with the uppermost recording medium P of the recording-medium bundle accommodated in the container 1 so as to feed the recording medium P.

In the configuration equipped with such a feed member 7, a representative installation position of the suppressing member 6 is located opposite from the feed member 7 in the delivery direction of the recording media P. According to this example, the suppressing member 6 is installed at a position where it does not interfere with the separating mechanism 2 or the feed member 7.

As an alternative installation example of the suppressing member 6 in the configuration equipped with the feed member 7, the suppressing member 6 may be provided in the feed member 7. The feed member 7 and the driving member 3 of the separating mechanism 2 may share the same driving source, or different driving sources may be provided therefor. Furthermore, although the suppressing member 6 ascends and descends together with the ascending-descending operation of the feed member 7, the feed member 7 ascends prior to the point when the driving member 3 of the separating mechanism 2 stops. In this case, the ascending-descending operation of the feed member 7 may be made adjustable in, for example, three levels by selecting an intermediate position in addition to the ascended position and the descended position of the feed member 7, so that the feed member 7 is kept in contact with a recording medium P for a predetermined time period even after the feed member 7 has moved away from the recording medium P by ascending therefrom.

A processing apparatus to which the above-described recording-medium feeding device is applied may be as follows. Specifically, the processing apparatus may include the above-described recording-medium feeding device and a processor that processes a recording medium P fed from the recording-medium feeding device. A representative example of such a processor is an image forming unit that forms an image onto a recording medium P. Alternatively, for example, the processor may be configured to perform a process, such as a hole-punching process, on each sheet of recording medium P.

Exemplary embodiments of the present invention will be described in further detail with reference to the appended drawings.

First Exemplary Embodiment

Overall Configuration of Image Forming Apparatus

Figure 4:
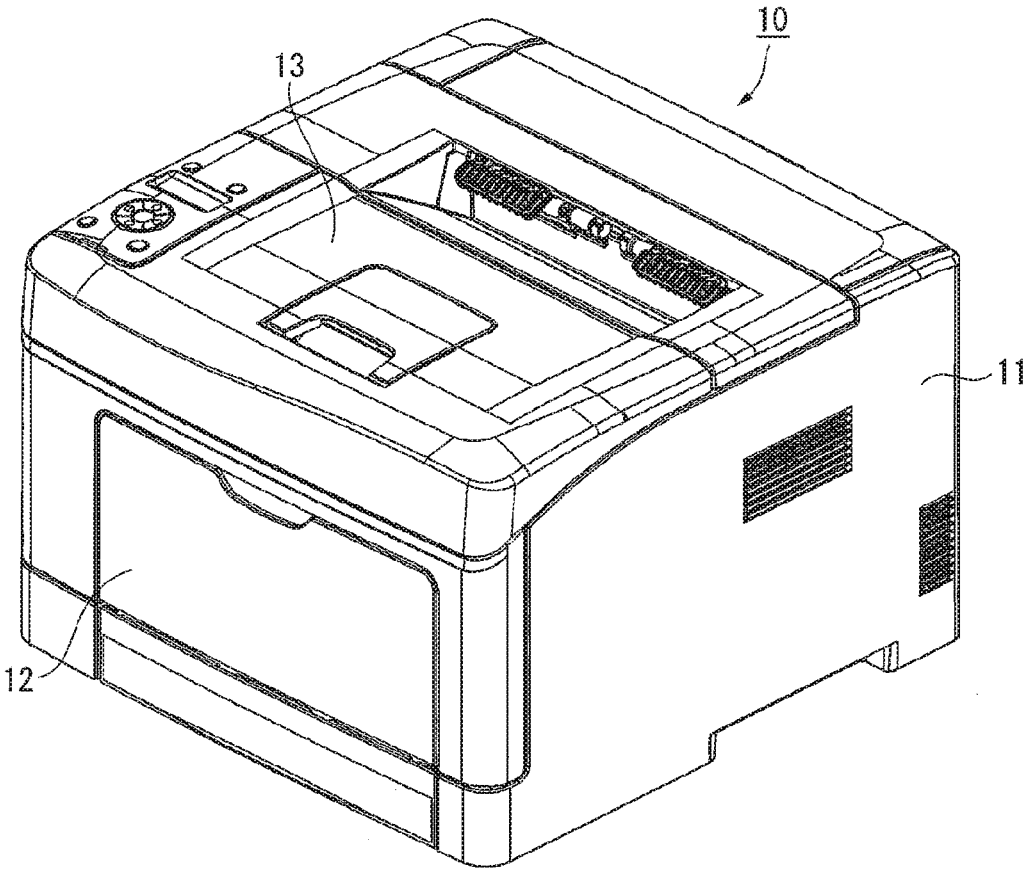
FIG. 4 is an external perspective view of an image forming apparatus according to a first exemplary embodiment.
Figure 5:
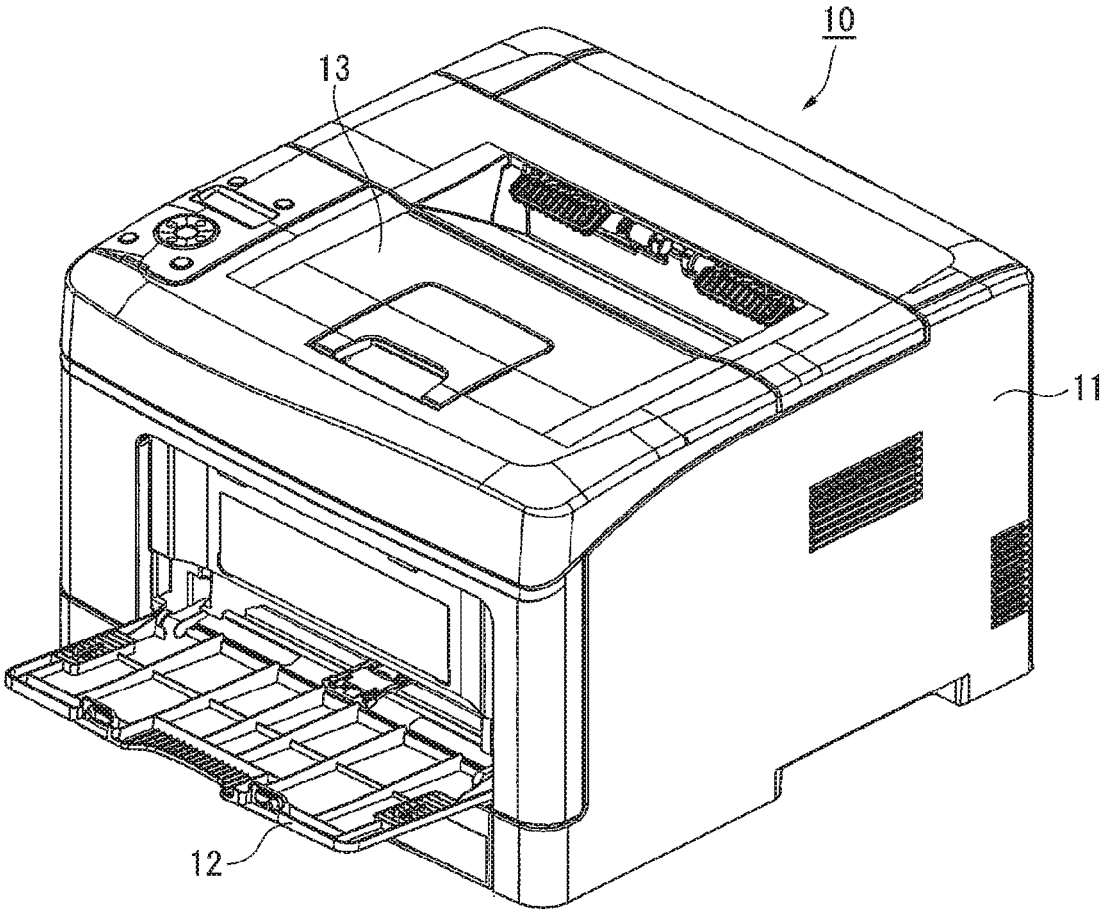
FIG. 5 is a perspective view illustrating a state where an openable-closable door in FIG. 4 is opened.
Figure 6:
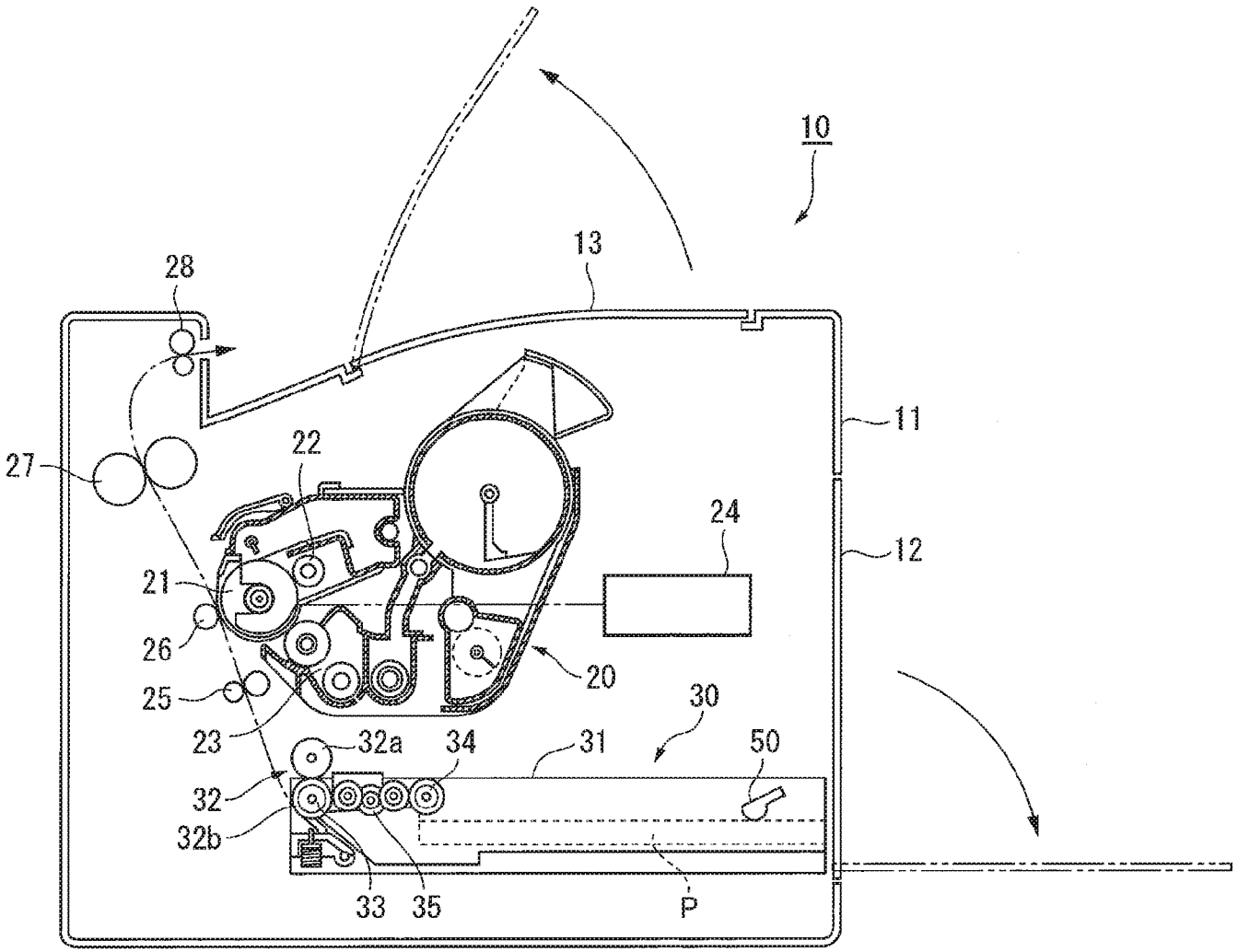
FIG. 6 schematically illustrates the image forming apparatus according to the first exemplary embodiment.

FIGS. 4 to 6 illustrate an image forming apparatus as an example of a processing apparatus equipped with a recording-medium feeding device according to a first exemplary embodiment. FIGS. 4 and 5 are external perspective views of the image forming apparatus. FIG. 5 illustrates a state where an openable-closable door in FIG. 4 is opened. FIG. 6 schematically illustrates the image forming apparatus.

In FIGS. 4 to 6, an image forming apparatus 10 according to this exemplary embodiment is provided with an openable-closable door 12 at the front surface of an apparatus housing 11 and is also provided with an openable-closable cover 13 at an upper portion of the apparatus housing 11 for loading and unloading a process cartridge 20, which will be described later. The process cartridge 20 serving as an element of an image forming unit as an example of a processor is installed substantially in the center within the apparatus housing 11. A recording-medium feeding device 30 that feeds recording media P is provided below the process cartridge 20. The recording-medium feeding device 30 according to this exemplary embodiment is configured to accommodate recording media P in a substantially horizontal position.

In the process cartridge 20, a photoconductor 21 having a photosensitive layer on the surface thereof is surrounded by, for example, a charging roller 22, which electrostatically charges the photosensitive layer, and a developing unit 23 that performs a developing process on the photosensitive layer. The openable-closable door 12 for the process cartridge 20 within the apparatus housing 11 is provided with an exposure unit 24 for forming an electrostatic latent image on the photosensitive layer electrostatically charged by the charging roller 22. The developing unit 23 develops the electrostatic latent image formed on the photosensitive layer by this exposure unit 24, whereby a toner image is formed on the photoconductor 21.

Furthermore, a transport path for a recording medium P fed from the recording-medium feeding device 30 is provided within the apparatus housing 11 of the image forming apparatus 10. This transport path is appropriately provided with, for example, a transport roller 25 for transporting the recording medium P toward the process cartridge 20, a transfer roller 26 for transferring the toner image on the photoconductor 21 of the process cartridge 20 onto the recording medium P, a fixing unit 27 for fixing the toner image transferred on the recording medium P onto the recording medium P, and an output roller 28 that outputs the recording medium P having undergone the fixing process onto the openable-closable cover 13 outside the apparatus housing 11.

Recording-Medium Feeding Device

The recording-medium feeding device 30 according to this exemplary embodiment includes an accommodation tray 31 as a container that accommodates recording media P; a separating mechanism 32 provided at the downstream end of the accommodation tray 31 in the recording-medium delivery direction; a feed roller (corresponding to a nudging roller) 34 as a feed member that is provided in an ascendable-descendible manner at a position opposite from the separating mechanism 32 in the delivery direction of the recording media P in the accommodation tray 31 and that descends to come into contact with the uppermost recording medium P of the recording-medium bundle accommodated in the accommodation tray 31 and to feed the recording medium P; and a suppressing member 50 (which will be described in detail later) that comes into contact with the uppermost surface of the recording media P in the accommodation tray 31 and suppresses receding movement of second and subsequent sheets of recording media P in the counter-delivery direction, which may occur when the separating mechanism 32 stops after delivering a single uppermost sheet of recording medium P.

The separating mechanism 32 in this exemplary embodiment includes a driving roller 32*a* as a driving member, a separating roller (corresponding to a retardation roller) 32*b* as a separating member, and a torque limiter 33. The driving roller 32*a* is provided toward the delivery direction of the recording media P in the accommodation tray 31. The driving roller 32*a* comes into contact with the uppermost recording medium P of the recording-medium bundle accommodated in the accommodation tray 31 and is rotationally driven to feed the recording medium P. The separating roller 32*b* is rotationally drivable by coming into contact with the driving roller 32*a* and separates the recording media P from each other in a one-by-one fashion. The torque limiter 33 is incorporated in the separating roller 32*b*. When a rotational torque smaller than a predetermined rotational torque (rotational load) is applied to the torque limiter 33, the torque limiter 33 repels the load of the rotational torque so as to inhibit rotation of the separating roller 32*b*. When a rotational torque larger than or equal to the predetermined rotational torque is applied to the torque limiter 33, the torque limiter 33 allows the separating roller 32*b* to be rotationally driven in accordance with the load of the rotational torque.

Figure 7:
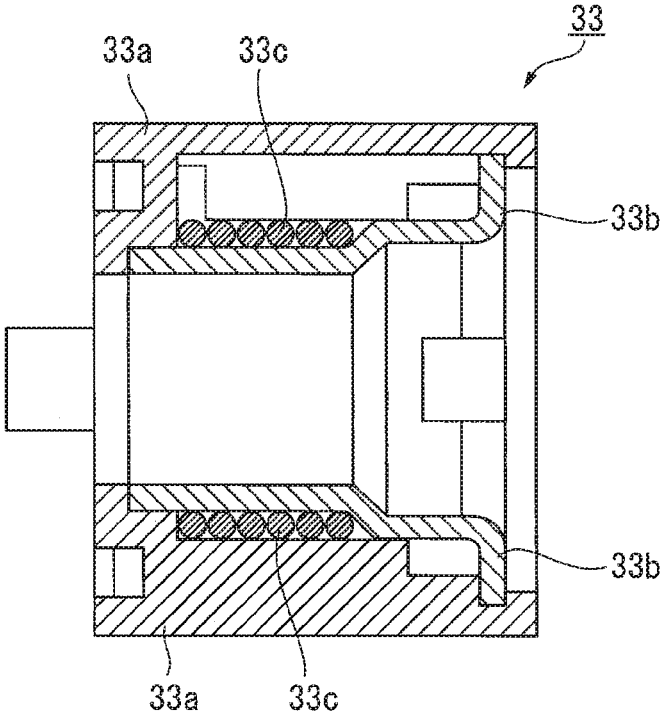
FIG. 7 illustrates the structure of a torque limiter.

The torque limiter 33 used in this exemplary embodiment is of a so-called spring type. As shown in a cross-sectional view in FIG. 7, an inner ring 33*b* is provided within an outer ring 33*a* as a housing, and a spring coil 33*c* is wound between the inner ring 33*b* and the outer ring 33*a*. A predetermined rotational load is set in accordance with the spring force of the spring coil 33*c*.

A gear train 35 constituted of multiple connected gears for transmitting the rotational force of the driving roller 32*a* to the feed roller 34 is provided between the driving roller 32*a* and the feed roller 34. Thus, the rotational force is transmitted from a driving gear (not shown) provided on a rotation shaft of the driving roller 32*a* toward a transmission gear (not shown) provided on a rotation shaft of the feed roller 34 via the gear train 35, whereby the feed roller 34 rotates in accordance with the rotation of the driving roller 32*a*.

Figure 8:
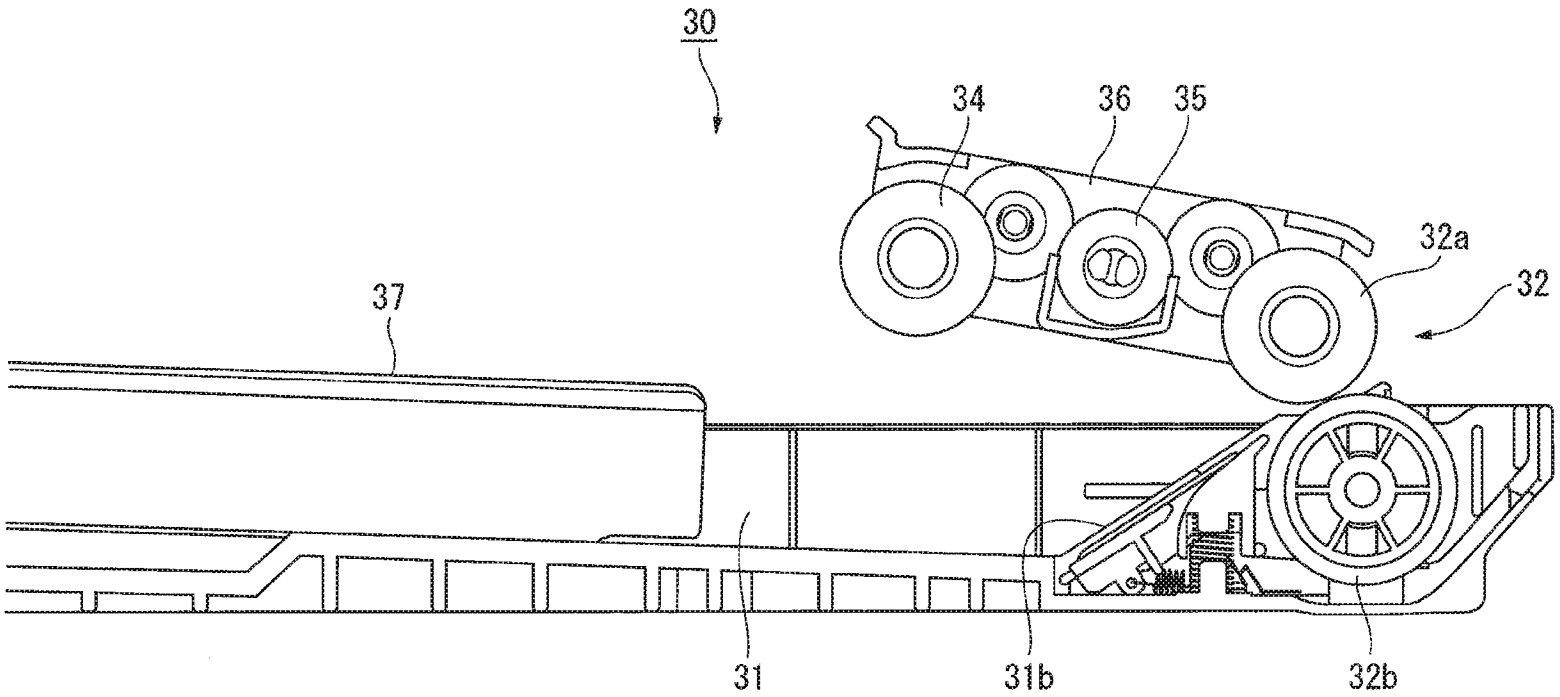
FIG. 8 illustrates the relationship between a separating mechanism and a feed roller in further detail.

FIG. 8 illustrates the relationship between the separating mechanism 32 and the feed roller 34 in further detail but does not show the torque limiter 33 or the recording media P. In FIG. 8, the driving roller 32*a*, the gear train 35, and the feed roller 34 are accommodated within a single frame body 36. The driving roller 32*a* and the feed roller 34 are partially exposed toward the recording media P from the frame body 36 so as to allow for recording-medium feeding and delivering operations. The rotation shafts of the driving roller 32*a*, the gear train 35, and the feed roller 34 are all rotatably supported by the frame body 36. Moreover, the frame body 36 is pivotable in the vertical direction in FIG. 8 about the rotation shaft of the driving roller 32*a* acting as a pivot axis. By causing the frame body 36 to pivot, the feed roller 34 is made to come into and out of contact with the recording media P within the accommodation tray 31 by ascending and descending between a descended position at which the feed roller 34 is in contact with the recording media P and an ascended position at which the feed roller 34 has receded from the recording media P. Reference sign 31*b* denotes an inclined section, which will be described below, of the accommodation tray 31. Reference sign 37 denotes side guides, which will be described below.

Figure 9:
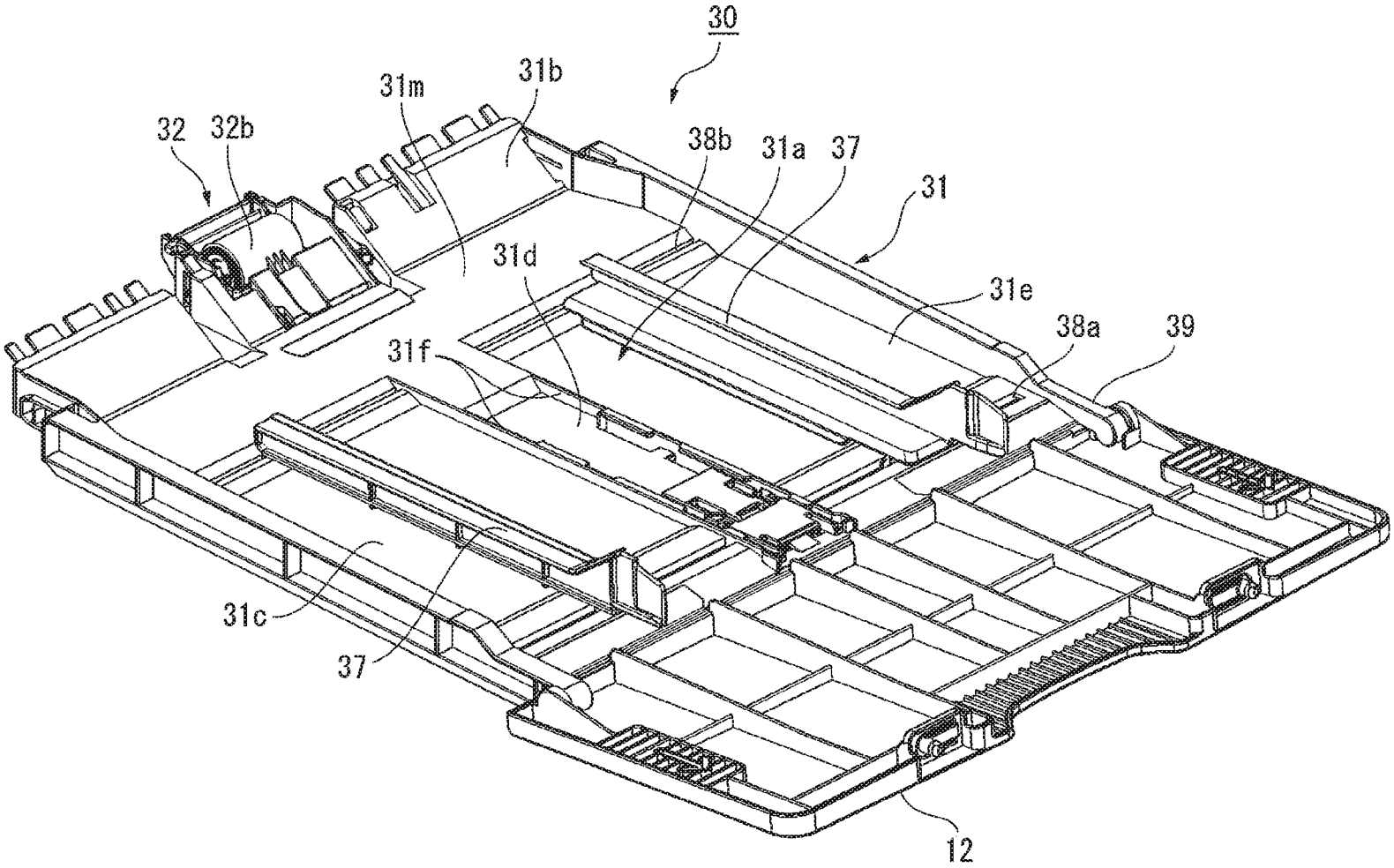
FIG. 9 is a perspective view schematically illustrating an accommodation tray according to the first exemplary embodiment.

As shown in FIG. 9, the accommodation tray 31 according to this exemplary embodiment has an accommodation section 31*a* that accommodates the recording media P in a substantially horizontal position and also has the inclined section 31*b* that is inclined upward at an angle from the bottom of the accommodation section 31*a* toward the separating mechanism 32 (only the separating roller 32*b* thereof is shown in FIG. 9).

In this exemplary embodiment, the accommodation section 31*a* has three recesses 31*c* to 31*e* that are recessed from an accommodation surface 31*m* where the recording media P are to be accommodated. Due to these recesses 31*c* to 31*e*, ribs 31*f* constituted of projections are formed as two guide rails extending in the delivery direction of the recording media P near the middle of the accommodation surface 31*m* for the recording media P.

A pair of side guides 37 for guiding the side edges of the accommodated recording media P are respectively attached to the two recesses 31*c* and 31*e* provided in the accommodation section 31*a* in the width direction thereof intersecting the delivery direction of the recording media P. These side guides 37 move along guide grooves 38*a* and 38*b* provided in the accommodation section 31*a* so as to be readily positioned in accordance with the width dimension of the recording media P.

Furthermore, in this exemplary embodiment, protrusions 39 protruding against the recording-medium delivery direction are provided at the opposite side edges of the accommodation section 31*a* and at the rear ends thereof in the recording-medium delivery direction. Shafts (not shown) provided in these protrusions 39 are fitted in bearings provided in the openable-closable door 12 so that the openable-closable door 12 is openable and closable relative to the accommodation tray 31.

Suppressing Member

Figure 10:
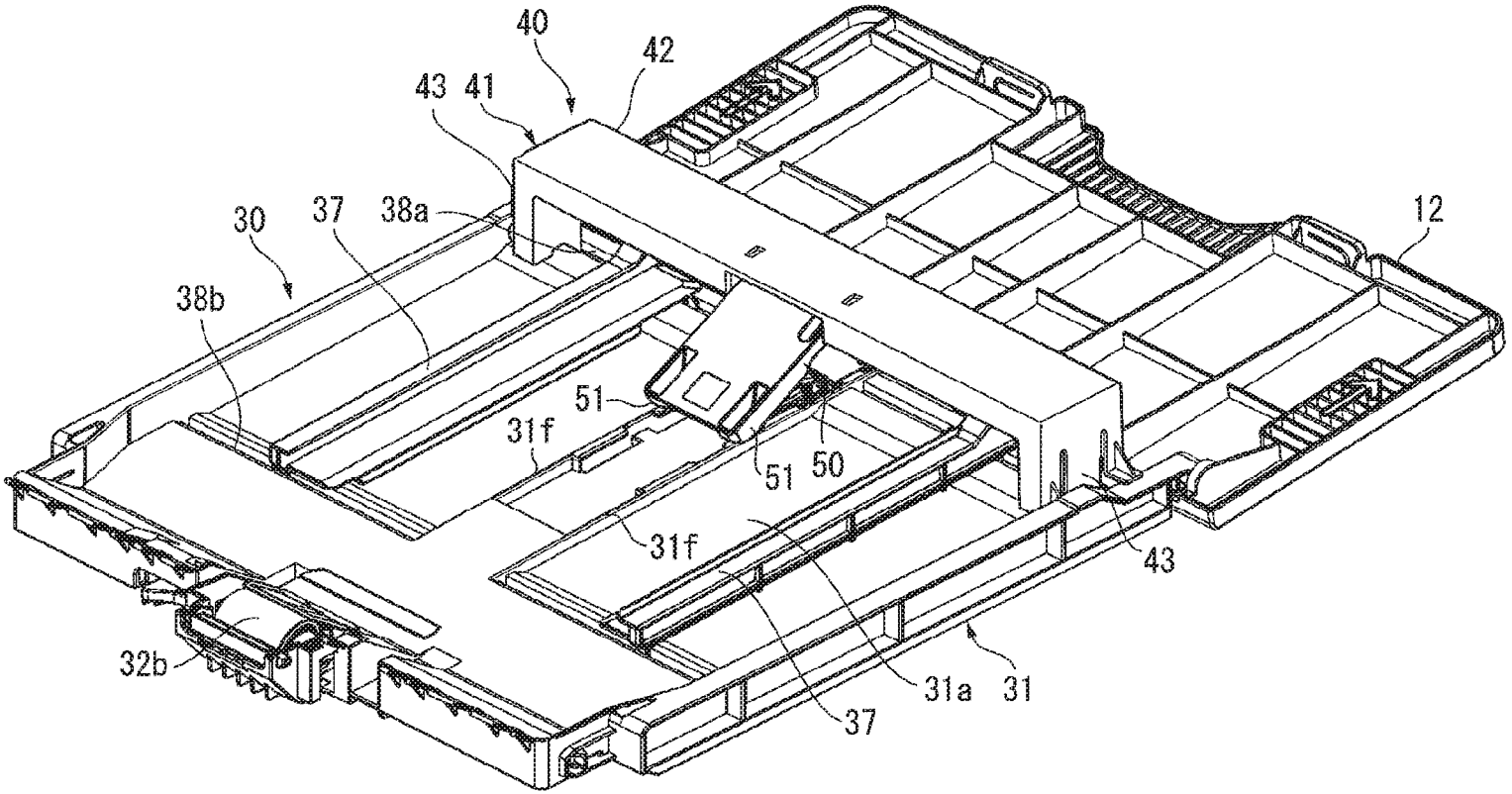
FIG. 10 is a perspective view illustrating a state where a suppressing unit having a suppressing member according to the first exemplary embodiment is attached to the accommodation tray.

FIG. 10 is a perspective view illustrating a state where a suppressing unit 40 equipped with the suppressing member 50 according to this exemplary embodiment is attached to the accommodation section 31*a* of the accommodation tray 31.

Figure 11:
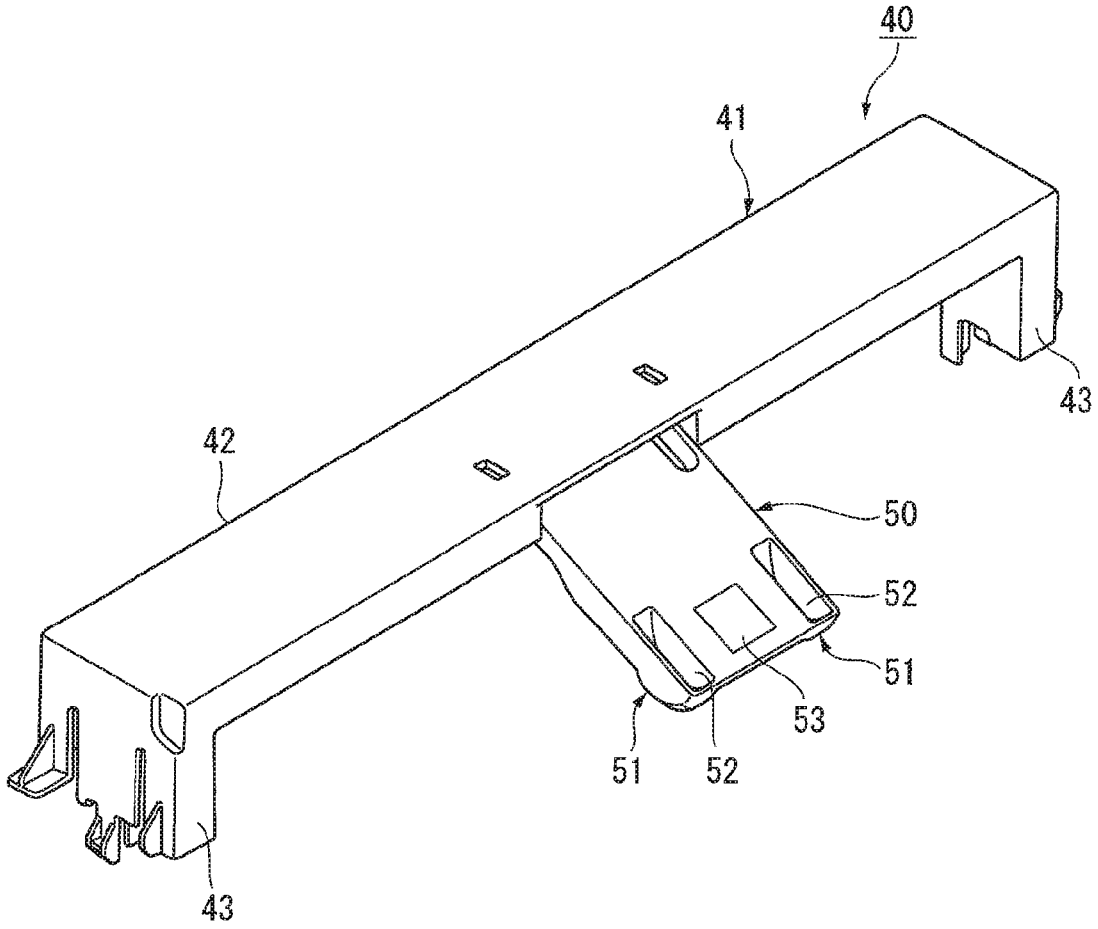
FIG. 11 is a perspective view illustrating the suppressing unit used in the first exemplary embodiment.
Figure 12:
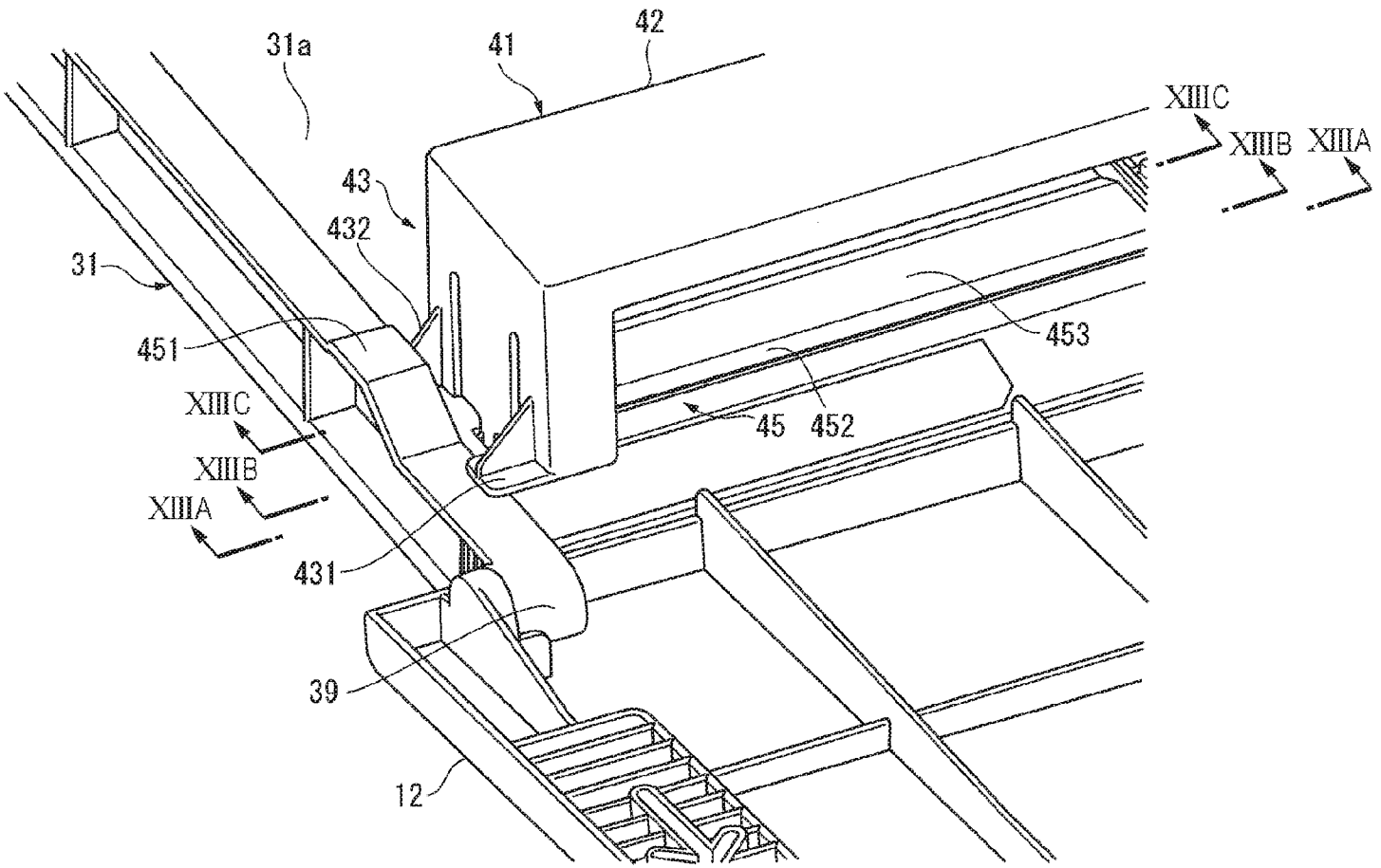
FIG. 12 illustrates a structural example in which a holder of the suppressing unit used in the first exemplary embodiment is attached.
Figure 13A:
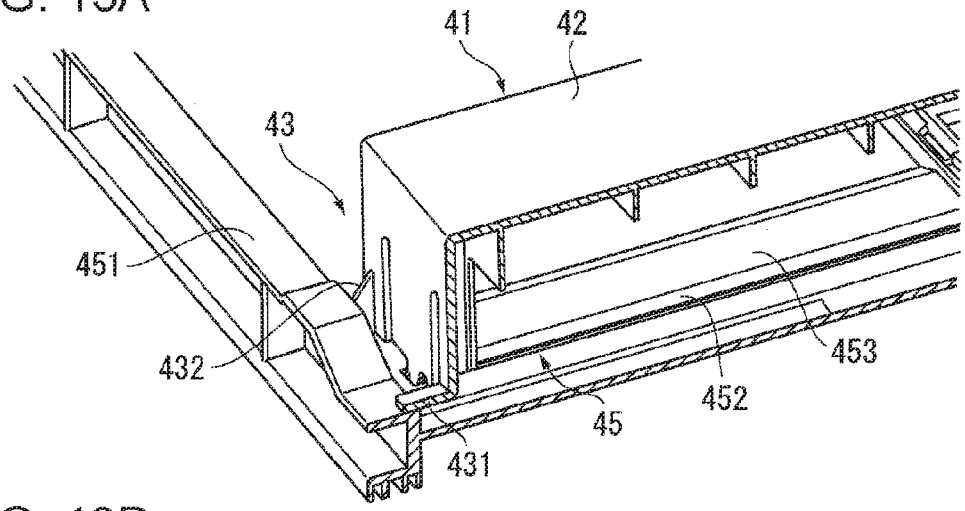
FIGS. 13A to 13C are cross-sectional views taken along lines XIIIA-XIIIA, XIIIB-XIIIB, and XIIIC-XIIIC, respectively, in FIG. 12.
Figure 13B:
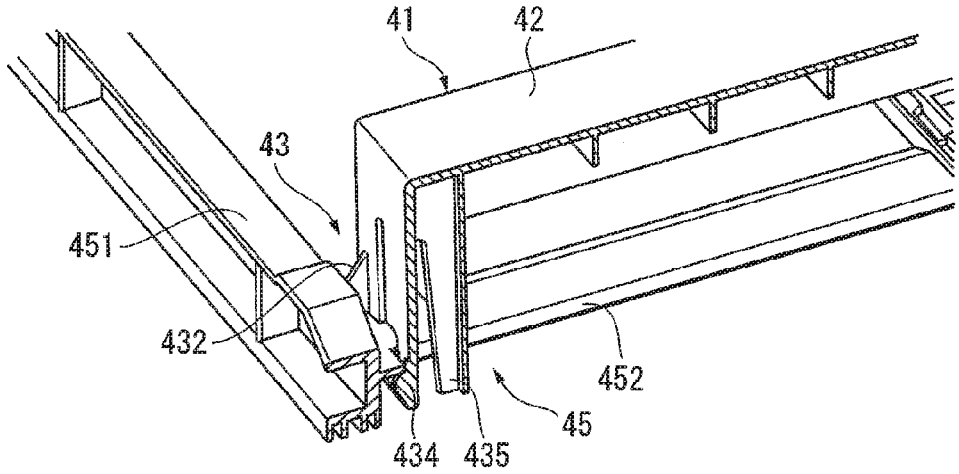
Figure 13C:
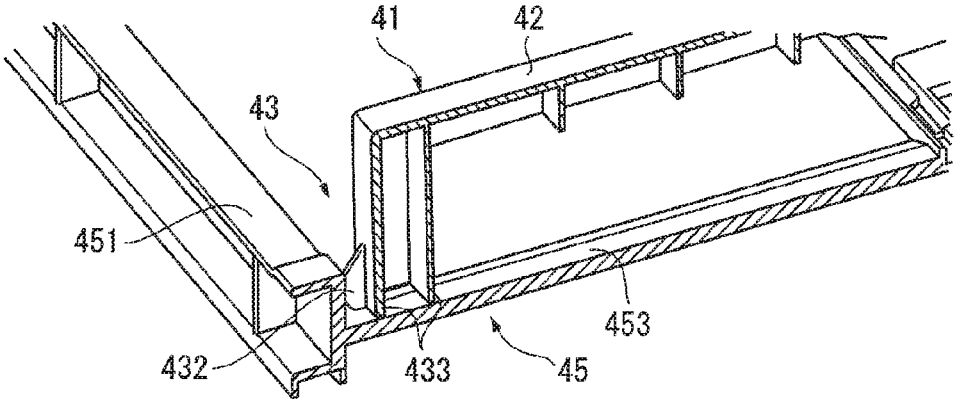

The suppressing unit 40 in this exemplary embodiment is an accessory component that is attachable to and detachable from the accommodation tray 31. The suppressing unit 40 is attached to the rear end of the accommodation section 31*a* in the recording-medium delivery direction so as to extend astride the recording media P in the width direction thereof. Moreover, as shown in FIG. 11, the suppressing unit 40 is constituted of the suppressing member 50 and a holder 41 that holds the suppressing member 50. The holder 41 is detachably attached to the opposite side edges of the accommodation section 31*a* and is constituted of a holder frame 42 and a pair of holder arms 43. The holder frame 42 has a length that exceeds the maximum widthwise size of recording media P to be used. The holder arms 43 extend from the opposite ends of the holder frame 42 toward the accommodation section 31*a* of the accommodation tray 31, and the ends of the holder arms 43 are detachably attached to the accommodation section 31*a*.

As shown in FIGS. 10 to 13C, the holder arms 43 in this exemplary embodiment are held by a holder receiver 45 defined by predetermined areas located at the opposite widthwise sides of the recording media P in the accommodation section 31*a* of the accommodation tray 31 and are configured to restrain the recording media P in the delivery direction and the width direction thereof.

Specifically, the holder receiver 45 has partition walls 451 located at the opposite sides of the accommodation tray 31 in the width direction of the recording media P, a long groove 452 formed in a part of the accommodation section 31*a* and extending in the width direction of the recording media P, and a step portion 453 in the accommodation section 31*a*. The step portion 453 extends in the longitudinal direction of the long groove 452 and is adjacent thereto.

The pair of holder arms 43 each have first and second abutment segments 431 and 432 at positions corresponding to the corresponding partition wall 451 of the holder receiver 45. Moreover, each holder arm 43 has a third abutment segment 433 at a position corresponding to the step portion 453, and also has first and second positioning segments 434 and 435 that protrude downward at positions corresponding to the long groove 452.

The first abutment segment 431 at a distal end of each holder arm 43 is provided at the openable-closable door 12 side thereof and protrudes substantially horizontally outward in the width direction of the recording media P so as to abut on the upper surface of the corresponding partition wall 451. The second abutment segment 432 provided at the distal end of each holder arm 43 is disposed away from the openable-closable door 12 and protrudes substantially vertically outward in the width direction of the recording media P so as to abut on the inner side surface of the corresponding partition wall 451. The third abutment segment 433 of each holder arm 43 is constituted of a pair of ribs extending substantially in the vertical direction of each holder arm 43 so as to abut on the upper surface of the step portion 453.

The first positioning segment 434 of each holder arm 43 extends vertically downward so as to be fittable into the long groove 452 and is elastically deformable based on a snap-fit configuration. The first positioning segment 434 is fitted into the long groove 452 of the holder receiver 45 and is hooked thereto to embrace an end of the long groove 452 so as to position the holder arm 43 in the width direction of the recording media P. Furthermore, the second positioning segment 435 of each holder arm 43 extends vertically downward so as to be fittable into the long groove 452. When fitted into the long groove 452, the second positioning segment 435 positions the holder arm 43 in the delivery direction of the recording media P.

Accordingly, in this exemplary embodiment, the holder arms 43 of the holder 41 are supported while being reliably set at predetermined positions by the holder receiver 45.

The suppressing member 50 is formed of a plate-shaped weight composed of, for example, polyoxymethylene (POM) plastic. A first end of the suppressing member 50 is pivotably attached to a substantially mid area of one side of the holder frame 42 of the holder 41. The opposite corners of a second end of the suppressing member 50 (i.e., the end distant from the pivot axis) are provided with two pressing sections 51 having curved surfaces for preventing scratches from being formed on a recording medium P to be delivered as a result of coming into contact with the recording medium P. In this exemplary embodiment, in order to form the pressing sections 51, the areas corresponding to the pressing sections 51 are made to protrude toward the recording media P. Therefore, recesses 52 having openings at the upper side thereof are formed in areas opposite to the aforementioned areas (i.e., the areas that do not come into contact with a recording medium P). Moreover, the suppressing member 50 in this exemplary embodiment also has another recess 53 formed between the two recesses 52.

Furthermore, the pressing sections 51 of the suppressing member 50 are set at positions facing the aforementioned ribs 31*f* (see FIGS. 9 and 10) as guide rails of the accommodation section 31*a* of the accommodation tray 31. Thus, the points where the suppressing member 50 applies pressure onto the recording media P correspond to the positions of the ribs 31*f*, so that stable pressure is applied onto the recording media P. The suppressing member 50 according to this exemplary embodiment is inclined downward at an angle from the holder frame 42 in the recording-medium delivery direction so that the pressing sections 51 are always contactable with the uppermost surface of the recording media P regardless of the number of accommodated sheets of recording media P.

In the recording-medium feeding device 30 having the above-described configuration, recording media P are supplied to the accommodation tray 31 in the following manner. Specifically, as shown in, for example, FIG. 10, the accommodation tray 31 together with the openable-closable door 12 is taken out from the apparatus housing 11. After setting the openable-closable door 12 substantially linearly with the accommodation tray 31, recording media P are inserted into an area corresponding to the holder frame 42 of the suppressing unit 40 from the openable-closable door 12 side. In this case, since the suppressing member 50 is inclined in a direction parallel to the inserting direction of the recording media P, the suppressing member 50 does not interfere with the insertion of the recording media P. If the recording media P in the accommodation tray 31 are to be replaced with recording media P of a different size, for example, the recording media P may be inserted from the openable-closable door 12 side after changing the positions of the side guides 37, or the recording media P may be set after detaching the suppressing unit 40 from the accommodation tray 31. Then, the suppressing unit 40 may be attached to the accommodation tray 31.

Operation in Accommodation Tray

The operation of the recording-medium feeding device 30 having the above-described configuration will now be described.

As shown in, for example, FIG. 8, in order to deliver a recording medium P from the accommodation tray 31, the frame body 36 having the driving roller 32*a* of the separating mechanism 32 and the feed roller 34 attached thereto is made to pivot about the rotation shaft of the driving roller 32*a* so as to bring the feed roller 34 into contact with the uppermost sheet of recording medium P. In this case, the rotational force of the driving roller 32*a* causes the separating roller 32*b* to rotate and also causes the feed roller 34 to rotate. Thus, the recording medium P is fed to the nip region N of the separating mechanism 32 via the inclined section 31*b* of the accommodation tray 31, that is, the nip region N between the driving roller 32*a* and the separating roller 32*b*.

In this exemplary embodiment, since the torque limiter 33 of a spring type is used in the separating roller 32*b*, it is assumed that the situations as described with reference to FIGS. 2A to 3C may occur.

However, even if the separating roller 32*b* reversely rotates due to the so-called spring-back effect by the torque limiter 33 when the driving of the driving roller 32*a* of the separating mechanism 32 is stopped after a first sheet of recording medium P is delivered from the nip region N of the separating mechanism 32, since the recording media P are pressed by the suppressing member 50, there is substantially no possibility of the leading edge of a second sheet of recording medium P receding relative to the leading edges of subsequent sheets of recording media P (i.e., receding relative to the nip region N of the separating mechanism 32), so that the subsequent operation in the separating mechanism 32 may be properly performed, thereby minimizing the occurrence of multi-feeding of recording media P.

Because the weight of a recording medium P normally varies from size to size, multi-feeding tends to occur more with small-size recording media P than large-size recording media P. However, even if there is a possibility of such problems, the suppressing member 50 is equipped with the recesses 52 and 53 in this exemplary embodiment, as shown in FIG. 11. Therefore, for example, if small-sized recording media P are to be used, the effect for suppressing receding movement of the recording media P may be sufficiently exhibited by adding, for example, a weight having an appropriate weight to the recesses 52 and 53 formed in the plate-shaped weight serving as the suppressing member 50, thereby minimizing the occurrence of multi-feeding of recording media P.

Although the torque limiter 33 in this exemplary embodiment is described as being of a spring type, the torque limiter 33 may alternatively be of, for example, a friction-plate type or a magnetic type. In that case, if it is assumed that reverse rotation of the separating roller 32*b* may occur due to an effect equivalent to the spring-back effect when the driving roller 32*a* stops, it is still better to use the suppressing member 50. Furthermore, although a configuration that uses the feed roller 34 is described in this exemplary embodiment, the suppressing member 50 may still be used even in a configuration that does not use the feed roller 34.

In this exemplary embodiment, a single suppressing member 50 is used in the suppressing unit 40. Alternatively, for example, multiple suppressing members 50 with different weights may be prepared. In that case, the most appropriate suppressing member 50 may be selected from among the multiple suppressing members 50 in accordance with the recording media P to be used, or the suppression of receding movement of the recording media P may be performed by using the multiple suppressing members 50 (e.g., by arranging multiple suppressing units 40 in the delivery direction of the recording media P).

Furthermore, in this exemplary embodiment, the accommodation tray 31 is disposed in a substantially horizontal position so that each recording medium P is delivered in the substantially horizontal direction. Alternatively, each recording medium P may be delivered in another direction instead of the horizontal direction. Moreover, although the openable-closable door 12 is attached to the accommodation tray 31, the suppressing member 50 may be used in a configuration in which the accommodation tray 31 is an independent component. Furthermore, although the suppressing member 50 is inclined downward at an angle in the delivery direction of the recording media P in this exemplary embodiment, the shape and the inclination direction of the suppressing member 50 may be determined in view of, for example, the direction in which the recording media P are inserted into the accommodation tray 31 or the delivering operation of the recording media P.

Second Exemplary Embodiment

Figure 14:
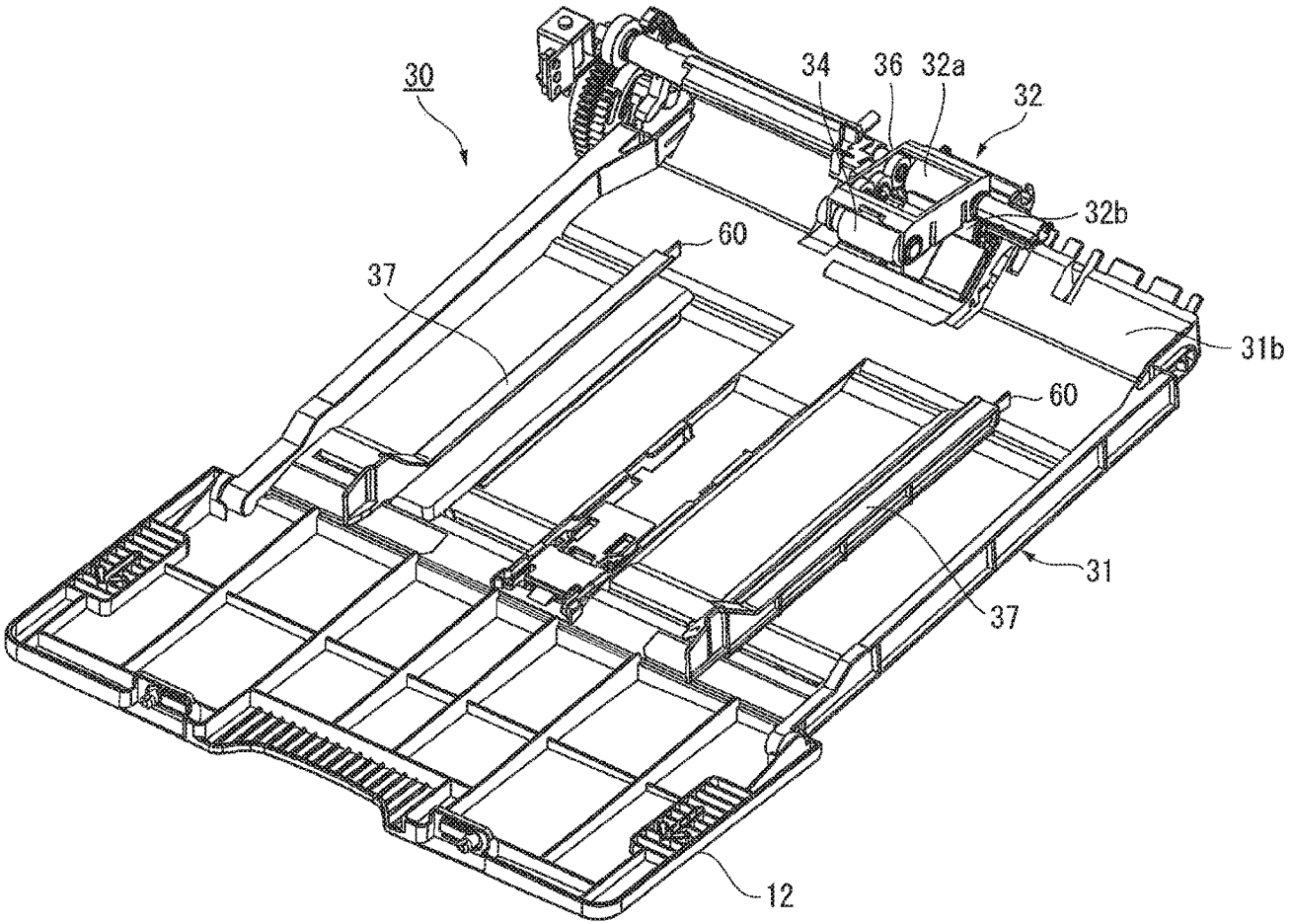
FIG. 14 is a perspective view schematically illustrating a recording-medium feeding device according to a second exemplary embodiment.
Figure 15:
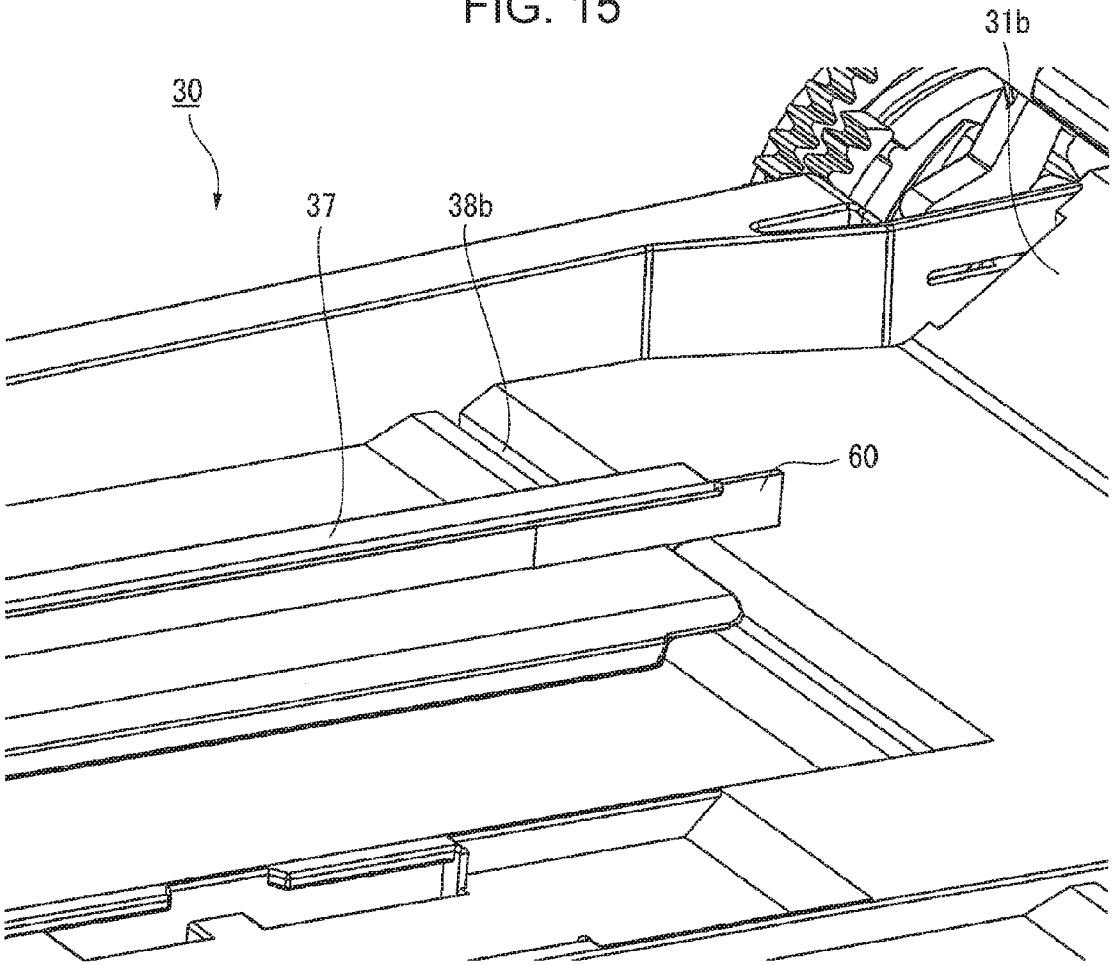
FIG. 15 is a partially enlarged view of FIG. 14.

FIGS. 14 and 15 are perspective views schematically illustrating a recording-medium feeding device 30 according to a second exemplary embodiment. FIG. 15 is a partially enlarged view of FIG. 14.

Although the recording-medium feeding device 30 according to this exemplary embodiment is substantially similar in configuration to the recording-medium feeding device 30 according to the first exemplary embodiment (see FIG. 10), suppressing members 60 different from the suppressing member 50 in the first exemplary embodiment are provided. The same elements will be given the same reference signs, and detailed descriptions thereof will be omitted here.

In FIGS. 14 and 15, the suppressing members 60 according to this exemplary embodiment are attached to the downstream side of the side guides 37 in the recording-medium delivery direction. Because the suppressing members 60 according to this exemplary embodiment are configured to come into contact with the opposite side surfaces of the recording media P within the accommodation tray 31, the suppressing members 60 are used as, for example, so-called planar fasteners each having a protrusion surface with raised protrusions on one side and an adhesive surface given an adhesive on the opposite side. By adhering these adhesive surfaces to the side guides 37, the protrusion surfaces are brought into abutment with the side surfaces of the recording media P. In this exemplary embodiment, the suppressing members 60 partially protrude toward the separating roller 32*b* from the ends of the side guides 37.

In this exemplary embodiment, the driving roller 32*a* stops after the uppermost recording medium P within the accommodation tray 31 passes through the nip region N of the separating mechanism 32, so that even when reverse rotation of the separating roller 32*b* occurs due to a torque limiter (not shown) attached to the separating roller 32*b*, movement of the recording media P in the counter-delivery direction is suppressed since the frictional resistance between the suppressing members 60 and the recording media P is high against a force that makes the recording media P move in the counter-delivery direction, thereby minimizing the occurrence of multi-feeding of recording media P. Moreover, in this exemplary embodiment, the suppressing members 60 partially protrude from the side guides 37 so as to come into contact with the recording media P even more stably, whereby the receding suppression effect on the recording media P may be sufficiently exhibited.

Although planar fasteners are used as the suppressing members 60, the suppressing members 60 are not limited thereto so long as the suppressing members 60 are capable of ensuring frictional resistance with the recording media P. For example, fibers with felt-like surface or rough-surface rubber may be used.

Third Exemplary Embodiment

Figure 16:
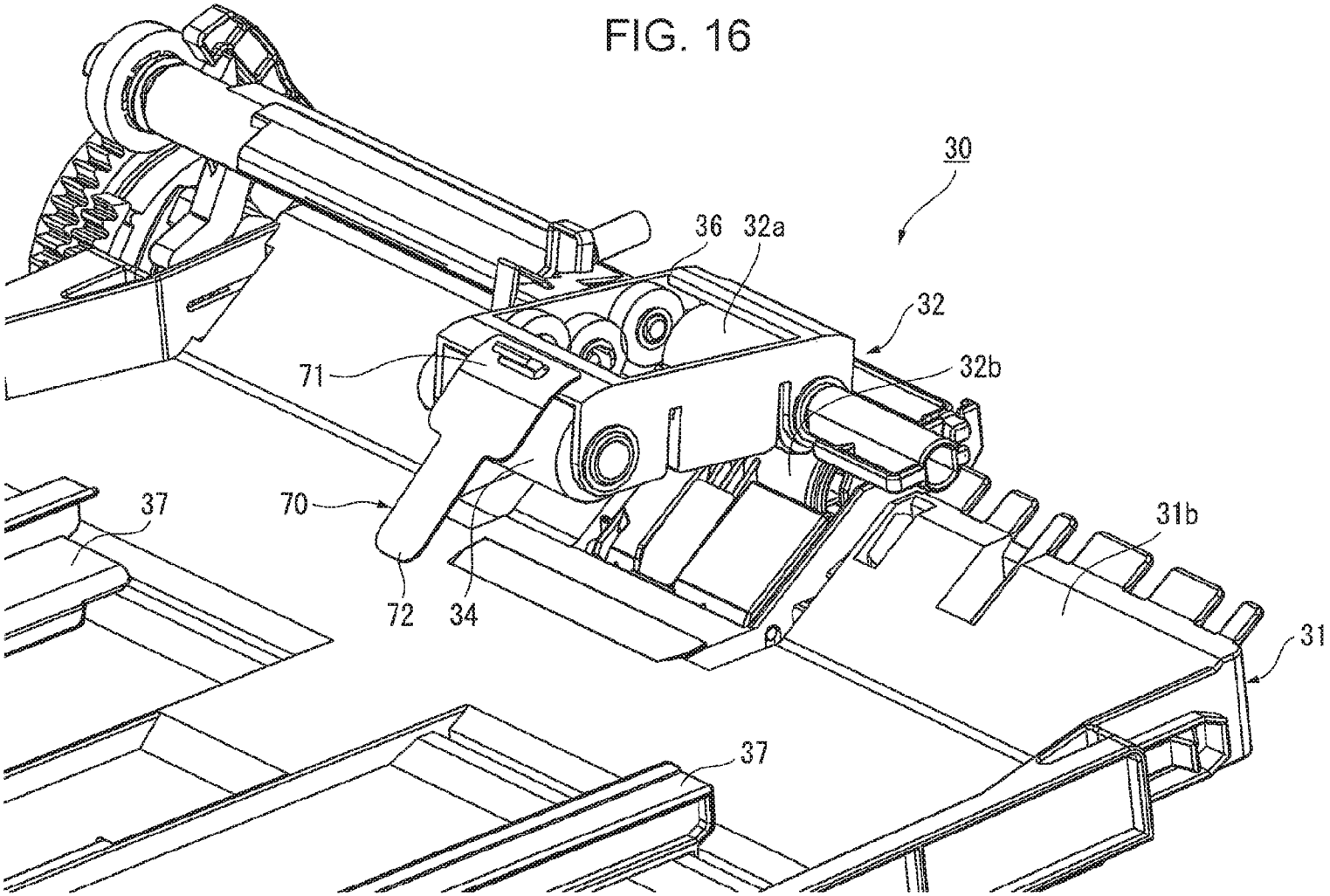
FIG. 16 is a perspective view schematically illustrating a recording-medium feeding device according to a third exemplary embodiment.
Figure 17:
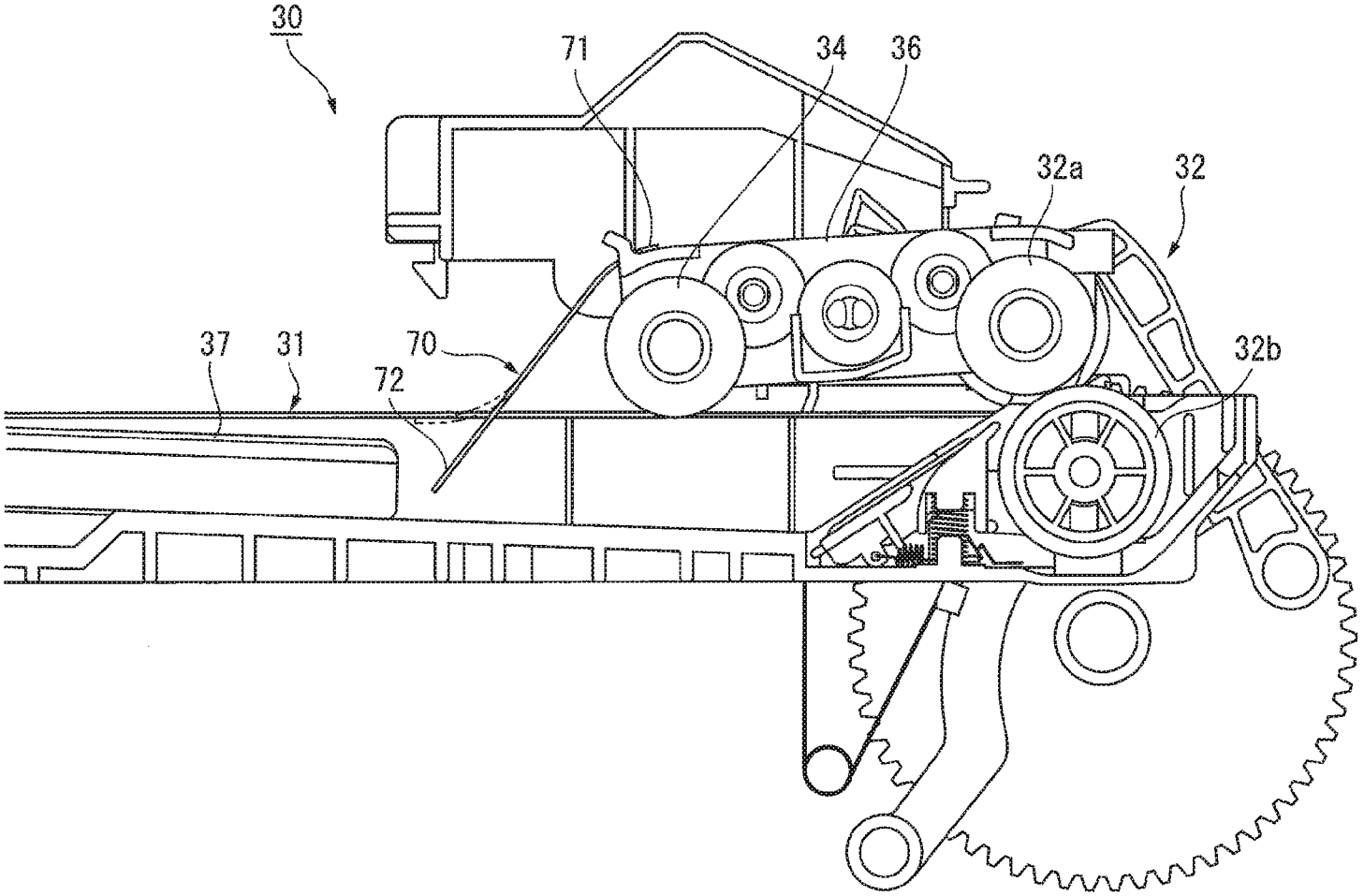
FIG. 17 schematically illustrates the operation according to the third exemplary embodiment and shows a suppressing member in a descended state.
Figure 18:
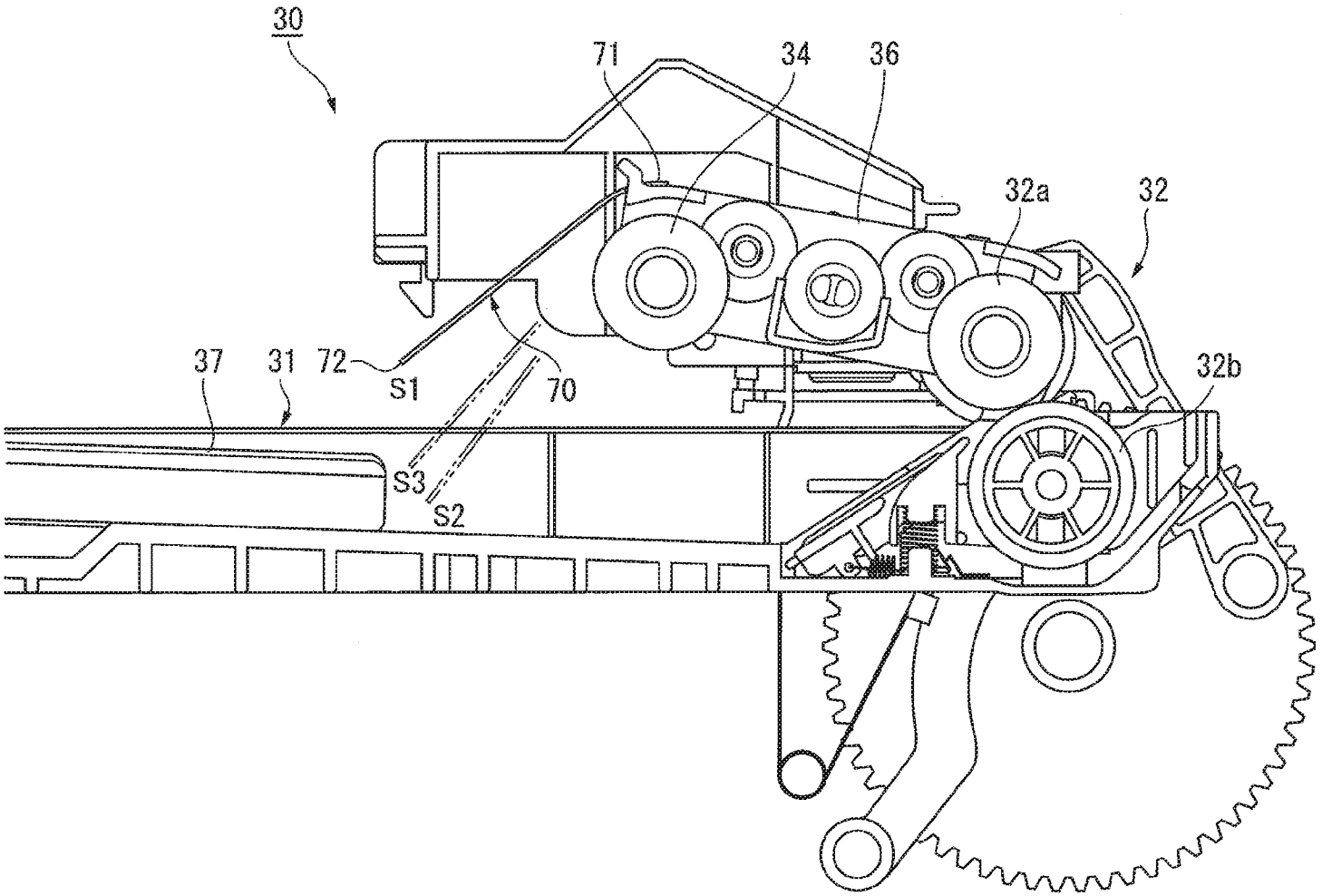
FIG. 18 schematically illustrates the operation according to the third exemplary embodiment and shows the suppressing member in an ascended state.

FIG. 16 is a perspective view of a recording-medium feeding device 30 according to a third exemplary embodiment, and FIGS. 17 and 18 schematically illustrate the operation thereof.

The recording-medium feeding device 30 according to this exemplary embodiment differs from the recording-medium feeding device 30 according to the first exemplary embodiment (e.g., see FIG. 8) in that a suppressing member 70 is disposed at the separating mechanism 32 side of the accommodation tray 31. Elements similar to those in the first exemplary embodiment are given the same reference signs, and detailed descriptions thereof will be omitted here.

In FIGS. 16 to 18, the suppressing member 70 in the recording-medium feeding device 30 according to this exemplary embodiment is a long elastic piece that is attached to the feed roller 34 side of the frame body 36 accommodating the driving roller 32*a* and the feed roller 34. In the suppressing member 70 according to this exemplary embodiment, a side 71 thereof different from the recording medium P side is secured to the frame body 36, whereas the side thereof in contact with the recording media P is a free end 72. The suppressing member 70 is composed of, for example, rubber or plastic. The suppressing member 70 is configured such that the pressing force applied therefrom to the recording media P does not greatly change in accordance with the length by which the suppressing member 70 is in contact with the recording media P.

FIG. 17 illustrates a state where the frame body 36 to which the suppressing member 70 is attached has descended. In this case, the feed roller 34 is in contact with the uppermost recording medium (not shown), and the suppressing member 70 deforms (as indicated by an imaginary line) to press against the uppermost recording medium, so that a sufficient pressing force against the recording medium P is ensured. In this state, the recording media P within the accommodation tray 31 are sequentially fed and are separated from each other by the separating mechanism 32 so as to be delivered from the accommodation tray 31.

FIG. 18 illustrates a state where the feed roller 34 has ascended as a result of pivoting of the frame body 36. The feed roller 34 is located at a position sufficiently distant from the recording media (not shown), and the suppressing member 70 attached to the frame body 36 is also distant from the recording media. The operation of the suppressing member 70 will be described in more detail. In FIG. 18, reference signs S1 to S3 indicate the positions of the suppressing member 70 based on the ascending-descending operation of the feed roller 34. Specifically, S1 indicates the position of the suppressing member 70 when the feed roller 34 has ascended, S2 indicates the position of the suppressing member 70 when the feed roller 34 has descended, and S3 indicates an intermediate position of the suppressing member 70. In this exemplary embodiment, when the feed roller 34 is disposed at the S2 or S3 position, the suppressing member 70 is maintained in contact with the uppermost recording medium P so as to apply a predetermined load onto the recording media P. Since the recording media are not shown in this case, the suppressing member 70 is shown as being in a free state.

In this exemplary embodiment, when the feed roller 34 descends to perform a feeding operation, the feed roller 34 comes into contact with the recording media P, and the suppressing member 70 is set at the S2 position. Then, when the feeding operation of the recording media P performed by the separating mechanism 32 ends, the feed roller 34 ascends away from the recording media P. In this case, the suppressing member 70 temporarily stops at the S3 position. Subsequently, the feed roller 34 further ascends so that the suppressing member 70 reaches the S1 position. In other words, when the feed roller 34 moves away from the recording media P, the suppressing member 70 changes in three levels from the S2 position to the S1 position via the S3 position.

Therefore, even when the separating roller 32*b* reversely rotates due to the spring-back effect by the torque limiter 33 after a single sheet of recording medium P is delivered from the separating mechanism 32, the suppressing member 70 is still in the process of moving from the S2 position to the S3 position. During this time, receding movement of the recording media P is sufficiently suppressed since the recording media P are sufficiently pressed by the suppressing member 70. As a result, the occurrence of multi-feeding of recording media P may be minimized. Although the feed roller 34 is described here as being configured to ascend in three levels, for example, the pressing force applied to the recording media P by the suppressing member 70 is sufficient until reverse rotation of the separating roller 32*b* ends during the ascending of the feed roller 34, so long as the length by which the suppressing member 70 is in contact with the recording media P (i.e., the length in the recording-medium delivery direction) is sufficiently ensured.

Fourth Exemplary Embodiment

Figure 19:
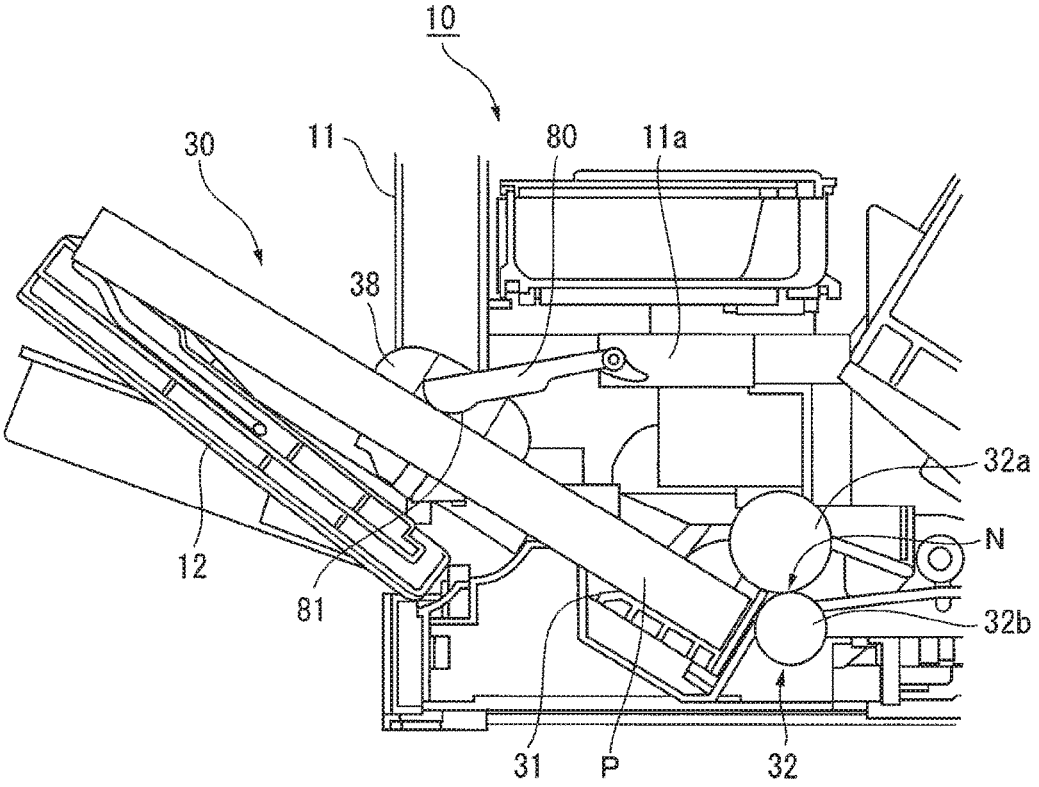
FIG. 19 schematically illustrates a recording-medium feeding device according to a fourth exemplary embodiment.

FIG. 19 schematically illustrates a recording-medium feeding device 30 according to a fourth exemplary embodiment. In this exemplary embodiment, an image forming apparatus substantially similar to the image forming apparatus according to the first exemplary embodiment is used. Therefore, the following description relates only to the recording-medium feeding device 30. The recording-medium feeding device 30 according to this exemplary embodiment differs from the recording-medium feeding device 30 according to the first exemplary embodiment (e.g., see FIG. 8) in that the accommodation tray 31 is installed at an angle and that the feed roller 34 is not provided. Although a torque limiter is not shown in FIG. 19, a torque limiter is installed. Elements similar to those in the first exemplary embodiment are given the same reference signs, and detailed descriptions thereof will be omitted here.

In FIG. 19, the accommodation tray 31 according to this exemplary embodiment is attached at an angle relative to the openable-closable door 12 provided in the apparatus housing 11 of the image forming apparatus 10. Moreover, the accommodation tray 31 does not have a section that is equivalent to the inclined section 31*b* in the first exemplary embodiment (e.g., see FIG. 8) but is provided with a lifting mechanism (not shown), which lifts the recording-medium bundle, near the separating mechanism 32. Therefore, the uppermost recording medium P is capable of reaching the nip region N of the separating mechanism 32 even without the feed roller 34.

Furthermore, in this exemplary embodiment, a suppressing member 80 is configured such that, for example, a first end thereof is pivotably supported by an attachment bracket 11*a* of the apparatus housing 11, and a pressing section 81 at a second end comes into contact with the surface of the uppermost recording medium P in the accommodation tray 31. The suppressing member 80 according to this exemplary embodiment is composed of, for example, POM and is equipped with the pressing section 81 at the side that comes into contact with the recording medium P. Moreover, the suppressing member 80 according to this exemplary embodiment is attached so as to be inclined in the counter-delivery direction of the recording media P and has sufficient weight to press against the recording media P.

In this exemplary embodiment, the separating roller 32*b* is provided with a spring-type torque limiter (not shown). However, even when the separating roller 32*b* reversely rotates due to the spring-back effect by the torque limiter 33 after a single sheet of recording medium P is delivered from the nip region N by the separating mechanism 32, receding movement of the recording media P is suppressed since the recording media P are pressed by the suppressing member 80, so that there is substantially no possibility of the leading edge of the uppermost recording medium P in the accommodation tray 31 being displaced in the counter-delivery direction relative to the leading edge of a subsequent recording medium P. Accordingly, the occurrence of multi-feeding of subsequent recording media P may be minimized.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording-medium feeding device comprising:

a container that accommodates a recording-medium bundle including a plurality of stacked recording media;

a separating mechanism including a driving member provided toward a recording-medium delivery direction in the container, the driving member coming into contact with an uppermost recording medium of the recording-medium bundle accommodated in the container and being rotationally driven to deliver the recording medium, a separating member that is rotationally drivable by coming into contact with the driving member and that separates the recording media from each other in a one-by-one fashion, and a torque limiter that is incorporated in the separating member, wherein when a rotational torque smaller than a predetermined rotational torque is applied to the torque limiter, the torque limiter repels a load of the rotational torque so as to inhibit rotation of the separating member, and wherein when a rotational torque larger than or equal to the predetermined rotational torque is applied to the torque limiter, the torque limiter allows the separating member to be rotationally driven in accordance with the load of the rotational torque; and a suppressing member that suppresses movement of the recording media in a direction opposite the delivery direction caused by reverse rotation of the separating member when the driving member of the separating mechanism stops.

2. The recording-medium feeding device according to claim 1, wherein the suppressing member is provided in an accessory component attachable to and detachable from the container.

3. The recording-medium feeding device according to claim 1, wherein, with respect to an uppermost surface of the recording-medium bundle accommodated in the container, the suppressing member is disposed at a position opposite from the separating mechanism in the recording-medium delivery direction.

4. The recording-medium feeding device according to claim 1, wherein the suppressing member is disposed as a weight whose weight is changeable on an uppermost surface of the recording-medium bundle accommodated in the container.

5. The recording-medium feeding device according to claim 1, wherein the container has an accommodation section that accommodates the recording media in a substantially horizontal position and also has an inclined section that is inclined upward at an angle from the accommodation section to a separating position of the separating mechanism.

6. The recording-medium feeding device according to claim 1, wherein a bottom portion of the container has a guide section extending in the recording-medium delivery direction, wherein the suppressing member has a pressing section at a position corresponding to the guide section, and wherein the pressing section and the guide section sandwich and press against the recording-medium bundle accommodated in the container.

7. The recording-medium feeding device according to claim 1, further comprising:

a feed member that is provided in the container in an ascendable-descendible manner at a position opposite from the separating mechanism in the recording-medium delivery direction, wherein when the feed member descends, the feed member comes into contact with the uppermost recording medium of the recording-medium bundle accommodated in the container so as to feed the recording medium, wherein the suppressing member is disposed at a position opposite from the feed member in the recording-medium delivery direction.

8. The recording-medium feeding device according to claim 1, further comprising:

a feed member that is provided in the container in an ascendable-descendible manner at a position opposite from the separating mechanism in the recording-medium delivery direction, wherein when the feed member descends, the feed member comes into contact with the uppermost recording medium of the recording-medium bundle accommodated in the container so as to feed the recording medium, wherein the suppressing member is provided in the feed member.

9. A processing apparatus comprising:

recording-medium feeding device according to claim 1; and a processor that processes a recording medium fed from the recording-medium feeding device.

* * * * *